US010587968B2

(12) United States Patent
Maeda

(10) Patent No.: US 10,587,968 B2
(45) Date of Patent: Mar. 10, 2020

(54) WIRELESS AUDIO SYSTEM, CONTROLLER, WIRELESS SPEAKER, AND COMPUTER READABLE SYSTEM

(71) Applicant: D&M Holdings, Inc., Kanagawa (JP)

(72) Inventor: Koji Maeda, Kanagawa (JP)

(73) Assignee: D&M Holdings, Inc., Kanagawa (JP)

( * ) Notice: Subject to any disclaimer, the term of this patent is extended or adjusted under 35 U.S.C. 154(b) by 0 days.

(21) Appl. No.: 16/076,029

(22) PCT Filed: Sep. 13, 2016

(86) PCT No.: PCT/JP2016/076893

§ 371 (c)(1),
(2) Date: Aug. 7, 2018

(87) PCT Pub. No.: WO2017/138182

PCT Pub. Date: Aug. 17, 2017

(65) Prior Publication Data

US 2019/0297439 A1 Sep. 26, 2019

(30) Foreign Application Priority Data

Feb. 8, 2016 (JP) ..... 2016-022260

(51) Int. Cl.

| | |
|---|---|
| ***H04R 3/12*** | (2006.01) |
| ***H04R 29/00*** | (2006.01) |
| ***H04S 7/00*** | (2006.01) |

(52) U.S. Cl.

CPC ..... *H04R 29/002* (2013.01); *H04R 3/12* (2013.01); *H04S 7/301* (2013.01); *H04R 2420/07* (2013.01)

(58) Field of Classification Search

CPC ..... H04R 29/002; H04R 3/12; H04R 2420/07

(Continued)

(56) References Cited

U.S. PATENT DOCUMENTS

| | | | | |
|---|---|---|---|---|
| 7,987,294 | B2 | 7/2011 | Bryce et al. | |
| 2005/0010874 | A1* | 1/2005 | Moder ..... | G11B 27/02 715/751 |

(Continued)

FOREIGN PATENT DOCUMENTS

| | | |
|---|---|---|
| JP | 2006-81110 | 3/2006 |
| JP | 2007-013707 | 1/2007 |

(Continued)

OTHER PUBLICATIONS

International Search Report and Written Opinion for PCT/JP2016/076893 dated Dec. 6, 2016.

*Primary Examiner* — Vivian C Chin
*Assistant Examiner* — Friedrich Fahnert
(74) *Attorney, Agent, or Firm* — Peter A. Nieves; Sheehan Phinney Bass & Green PA

(57) ABSTRACT

[Problem] In the case where an audio signal of the same source is output from a plurality of speakers, the speakers are adjusted so that the audio signals become optimal at a listening position. [Solution] Processing in which an audio signal output from a wireless speaker 1 is collected by a microphone of a controller 2 carried by a listener and a delay time is measured that is the difference between an output time of the audio signal from the wireless speaker 1 and an input time of the audio signal to the microphone of the controller 2 is performed on a plurality of the wireless speakers 1 that output an audio signal of the same source, and the delay times of the audio signals from these respective wireless speakers 1 are measured. Output timings of these respective wireless speakers 1 are adjusted on the basis of these delay times.

4 Claims, 20 Drawing Sheets

(58) Field of Classification Search
USPC ..... 381/59; 700/94; 704/271; 715/751
See application file for complete search history.

(56) References Cited

U.S. PATENT DOCUMENTS

| | | | | |
|---|---|---|---|---|
| 2013/0339025 | A1* | 12/2013 | Suhami | H04R 25/00 704/271 |
| 2015/0193198 | A1* | 7/2015 | Hutchings | G06F 3/165 700/94 |
| 2016/0262120 | A1* | 9/2016 | Shani | H04W 40/244 |
| 2017/0094223 | A1* | 3/2017 | Burenius | H04N 7/15 |
| 2017/0142536 | A1* | 5/2017 | Hattori | H04N 5/60 |
| 2018/0302716 | A1* | 10/2018 | Takasu | H04R 1/06 |

FOREIGN PATENT DOCUMENTS

| | | |
|---|---|---|
| JP | 2009-246911 | 10/2009 |
| WO | 2007/116825 | 10/2007 |

* cited by examiner (A)

(B)

WIRELESS SPEAKER 1

OUTPUT CHARACTERISTIC ADJUSTMENT PROCESSING S222

WIRELESS AUDIO SYSTEM, CONTROLLER, WIRELESS SPEAKER, AND COMPUTER READABLE SYSTEM

CROSS-REFERENCE TO RELATED APPLICATIONS

This application is the National Stage of International Application No. PCT/JP2016/076893, filed Sep. 13, 2016, which claims the benefit of Japanese Patent Application No. 2016-022260, filed Feb. 8, 2016. The contents of these prior applications are incorporated by reference herein in their entirety.

TECHNICAL FIELD

The present invention relates to a technology of controlling a wireless speaker.

BACKGROUND ART

In Patent Literature 1, there is disclosed a wireless audio system, which includes a plurality of wireless speakers grouped into a plurality of groups, and is capable of playing back music data that is different for each group. In the wireless audio system, for each group, the plurality of wireless speakers belonging to the group perform arbitration to select one wireless speaker from among those wireless speakers. Then, the selected wireless speaker serves as a group leader to receive from a user an operation for the plurality of wireless speakers belonging to the same group and transmit a control signal to those wireless speakers. With this wireless audio system, for example, when a plurality of wireless speakers are installed in each of a plurality of rooms, and the wireless speakers installed in the same room are set as belonging to the same group, music data that is different for each room may be played back.

Further, in Patent Literature 2, there is disclosed a wireless communication system capable of acquiring accurate positional information and enabling construction of a communication system that suppresses costs. This wireless communication system measures a distance to a wireless device based on a received radio wave strength of a wireless signal output from the wireless device.

CITATION LIST

Patent Literature

[PTL 1] U.S. Pat. No. 7,987,294 B2
[PTL 2] JP 2006-81110 A

SUMMARY OF INVENTION

Technical Problem

Incidentally, in the wireless audio system described in Patent Literature 1, when an audio signal of the same source is output from a plurality of speakers set to the same group, output levels and output timings of those speakers are required to be adjusted individually so that audio signals output from the respective speakers are optimal at a listening position, resulting in a complicated setting task.

Meanwhile, a distance to a listener from each speaker may be measured by applying the technology described in Patent Literature 2 to the wireless audio system described in Patent Literature 1. Specifically, it is possible to measure the distance to the listener from each speaker by detecting the received radio wave strength of a wireless signal output from the speaker by using a controller held by the listener. Then, the output level and output timing of each speaker may be adjusted depending on the distance to the speaker from the listener, to thereby resolve the complexity of the setting task.

However, even when the distance to the speaker from the listener is the same, the manner (delay period and input-to-output ratio) of transmission of a sound differs depending on, for example, arrangement of walls, existence of an obstacle, and an orientation of a speaker. Thus, an audio signal output from each speaker may not be optimal at the listening position by simply adjusting the output level and output timing of the speaker depending on the distance to the speaker from the listener.

The present invention has been made in view of the above-mentioned circumstances, and an object thereof is to provide a technology of enabling, when an audio signal of the same source is output from a plurality of speakers, each speaker to be adjusted so that the audio signal is optimal at the listening position.

Solution to Problem

In order to solve the above-mentioned problem, according to one embodiment of the present invention, a microphone of a controller held by a listener collects a sound of an audio signal output from a wireless speaker, and processing of measuring a delay period, which is a difference between an output time of the audio signal from the wireless speaker and an input time of the audio signal into the microphone of the controller, is performed for a plurality of wireless speakers configured to output an audio signal of the same source, to thereby measure the delay period of an audio signal of each wireless speaker. Then, the output timings of the respective wireless speakers are adjusted based on those delay periods.

In this case, processing of measuring an input-to-output ratio, which is a ratio of an input level of an audio signal into the microphone of the controller to an output level of the audio signal from the wireless speaker, maybe performed for the plurality of wireless speakers configured to output an audio signal of the same source, to thereby measure the input-to-output ratio of the audio signal of each wireless speaker. Then, the output levels of the respective wireless speakers may be adjusted based on those input-to-output ratios. In this processing, it may be determined whether those wireless speakers are installed in the room accommodating the listener with the controller based on the input-to-output ratios of audio signals of the respective wireless speakers, and a wireless speaker that is determined not to be installed in the same room may be excluded from the group of wireless speakers configured to output an audio signal of the same source.

Further, relative positions of the plurality of wireless speakers configured to output an audio signal of the same source with respect to the controller may be detected based on received radio wave strengths of wireless signals output from those wireless speakers, and an audio signal output mode such as a stereo mode or a sound mode may be determined based on the number and relative positions of wireless speakers configured to output an audio signal of the same source.

For example, according to one embodiment of the present invention, there is provided a wireless audio system, comprising a plurality of wireless speakers and a controller configured to remotely operate the plurality of wireless speakers, wherein the plurality of wireless speakers each include:

test signal output means for outputting a test signal, which is a predetermined audio signal, to notify the controller of an output time of the test signal, or for outputting the test signal at an output time designated in a test instruction, which is received from the controller, in accordance with the test instruction; and output adjustment means for adjusting an output timing of an audio signal to be played back in accordance with an output adjustment instruction received from the controller, and wherein the controller includes:

a microphone configured to collect a sound of the test signal;

measurement means for measuring a delay period, the delay period being a difference between the output time of the test signal received from each of the plurality of wireless speakers or the output time of the test signal designated in the test instruction and an input time of the test signal into the microphone, in which the controller transmits the test instruction to each of the plurality of wireless speakers to cause the each of the plurality of wireless speakers to output the test signal, and to cause the microphone to collect the sound of the test signal, and;

determination means for determining an output timing of each of the plurality of wireless speakers based on the delay period of the each of the plurality of wireless speakers measured by the measurement means; and output adjustment instruction transmission means for transmitting, to each of the plurality of wireless speakers, the output adjustment instruction containing designation of the output timing of the each of the plurality of wireless speakers determined by the determination means.

Advantageous Effects of Invention

According to one embodiment the present invention, the microphone of the controller held by the listener collects a sound of an audio signal output from a wireless speaker, and processing of measuring a delay period, which is a difference between the output time of the audio signal from the wireless speaker and the input time of the audio signal into the microphone of the controller, is performed for each of a plurality of wireless speakers configured to output an audio signal of the same source, to thereby adjust the output timing of the wireless speaker based on the delay period of the audio signal of the wireless speaker. Therefore, for example, it is possible to adjust each wireless speaker so that an audio signal output from the wireless speaker reaches a listening position at the same timing and becomes an optimal audio signal at the listening position.

DESCRIPTION OF EMBODIMENTS

Now, embodiments of the present invention are described with reference to the drawings.

[First Embodiment]

Figure 1:
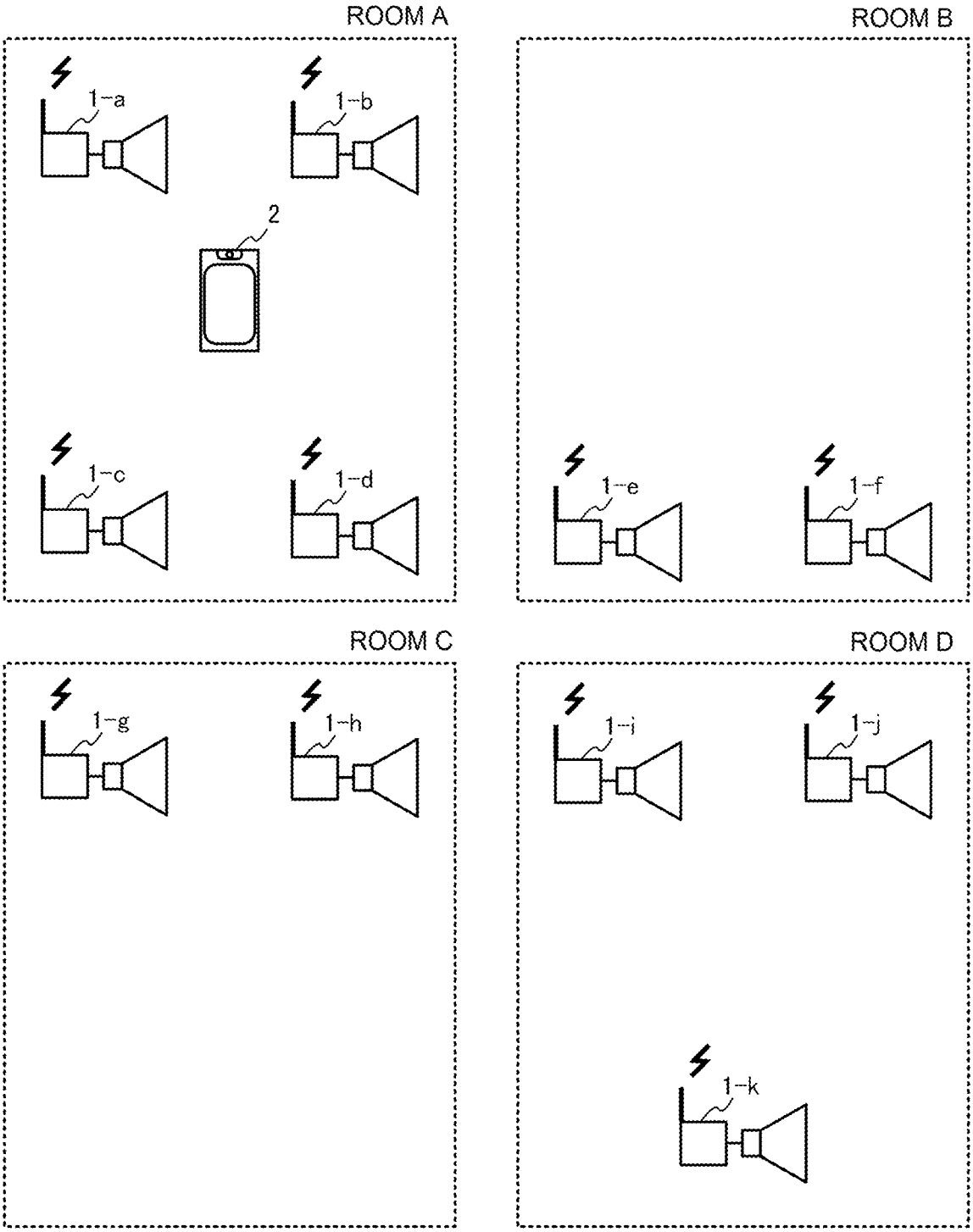
FIG. 1 is a schematic configuration diagram of a wireless audio system according to a first embodiment of the present invention.

FIG. 1 is a schematic configuration diagram of a wireless audio system according to a first embodiment of the present invention.

As illustrated in FIG. 1, the wireless audio system according to this embodiment includes a plurality of wireless speakers 1-*a* to 1-*k* (hereinafter also referred to simply as "wireless speaker 1") configured to play back and output an audio signal of music data and a controller 2 configured to remotely operate the wireless speaker 1. It is assumed that the wireless speakers 1-*a* to 1-*d* are installed in a room A, the wireless speakers 1-*e* and 1-*f* are installed in a room B, the wireless speakers 1-*g* and 1-*h* are installed in a room C, and the wireless speakers 1-*i* to 1-*k* are installed in a room D.

The wireless speaker 1 is configured to play back and output an audio signal of music data in accordance with output characteristics (output timing and output level) and an audio signal output mode (e.g., stereo mode, 2.1 channel mode, or 4 channel mode) of the audio signal set by the controller 2.

The controller 2 is configured to group the wireless speakers 1 arranged in the same room as the wireless speakers 1 configured to output an audio signal of the same music data, and set the output characteristics and output mode of each wireless speaker 1 belonging to the group. Further, the controller 2 is configured to transmit music data to be played back by each wireless speaker 1 belonging to the group.

Figure 2:
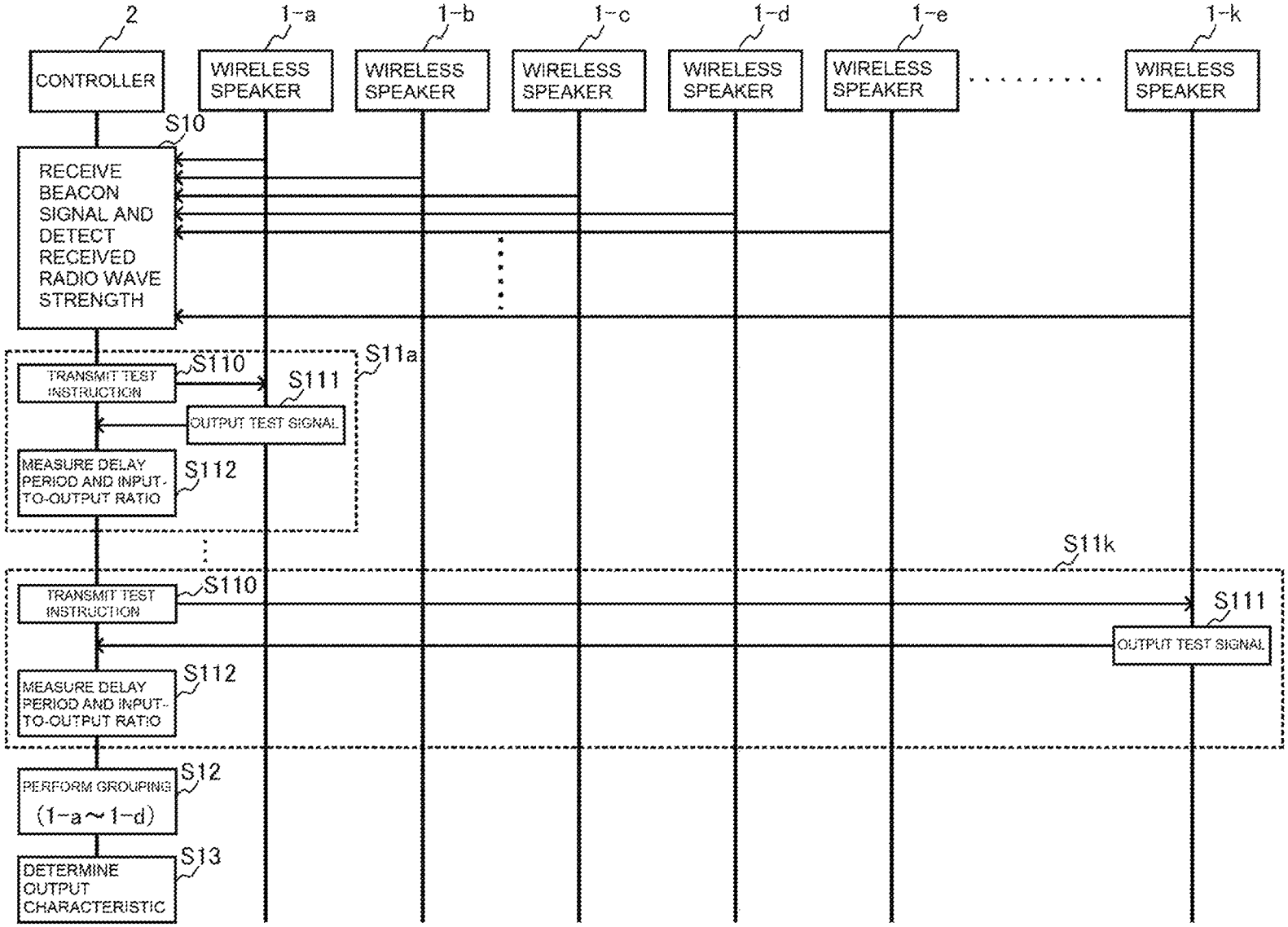
FIG. 2 is a flowchart for illustrating an operation of a wireless audio system according to the first embodiment of the present invention.
Figure 3:
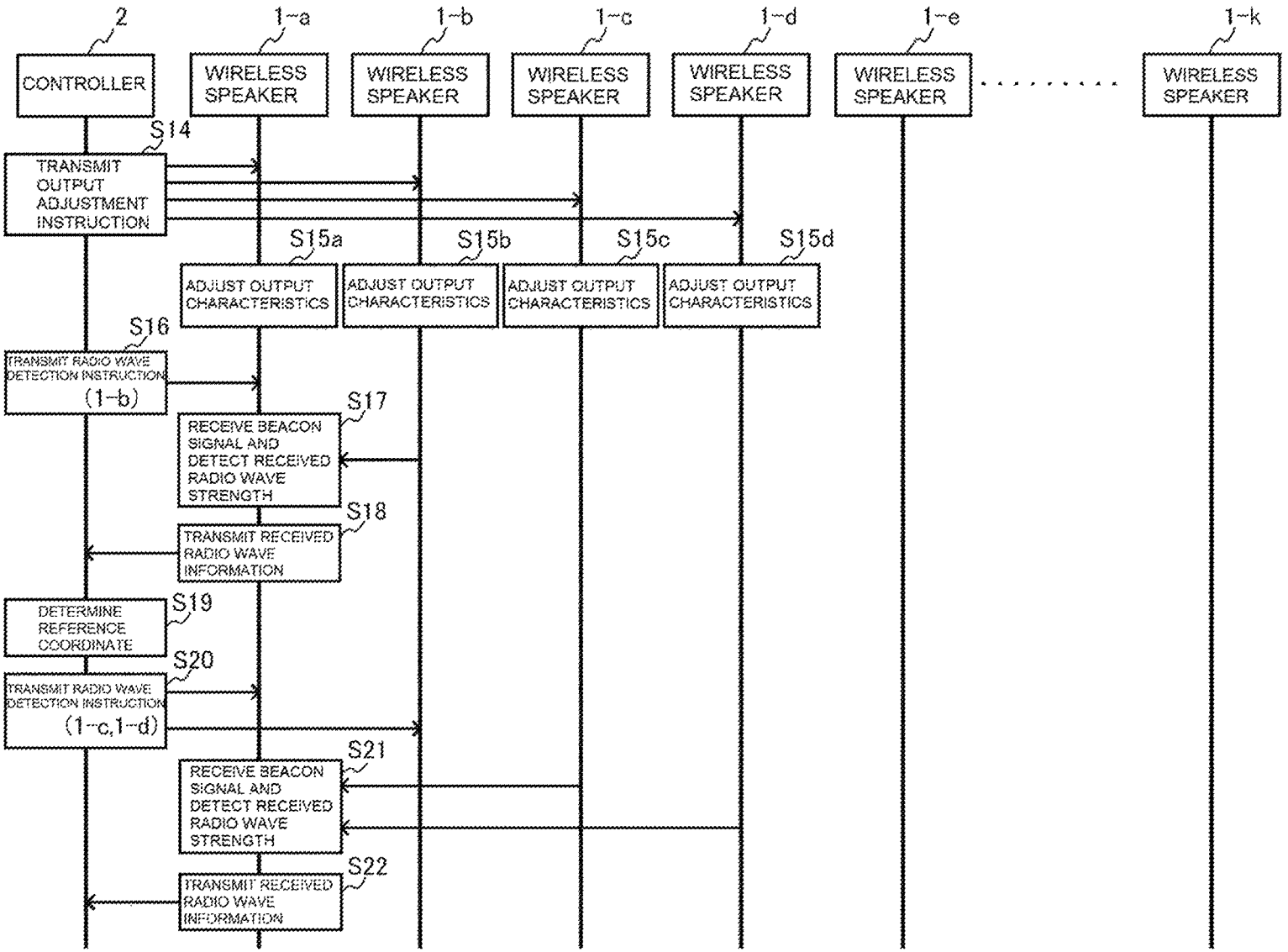
FIG. 3 is a flowchart for illustrating an operation of the wireless audio system, which is a continuation of FIG. 2, according to the first embodiment of the present invention.
Figure 4:
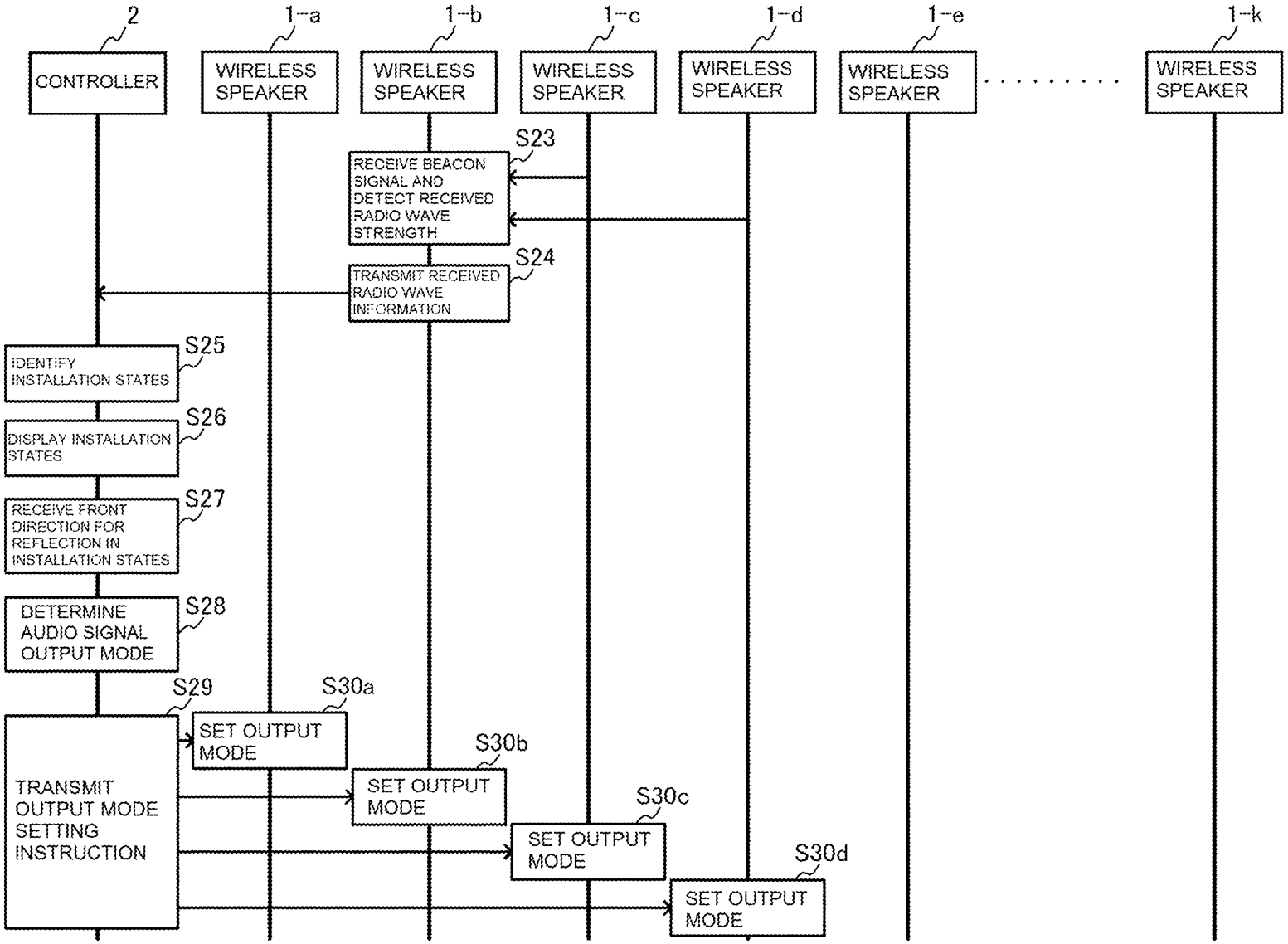
FIG. 4 is a flowchart for illustrating an operation of the wireless audio system, which is a continuation of FIG. 3, according to the first embodiment of the present invention.

FIG. 2 to FIG. 4 are flowcharts for illustrating an operation of the wireless audio system according to this embodiment. Now, a description is given by taking an exemplary case in which a listener with the controller 2 sets the output characteristics and output mode of the wireless speakers 1-*a* to 1-*d* arranged in the room A.

Each wireless speaker 1 periodically transmits a beacon signal including an ID assigned to the own wireless speaker 1 in a wireless manner. When the controller 2 receives an instruction to set the configuration of the wireless audio system from the listener with the controller 2 in the room. A, the controller 2 receives the beacon signal transmitted from each wireless speaker 1 and detects a received radio wave strength thereof (Step S10). In this description, it is assumed that beacon signals of all the wireless speakers 1-*a* to 1-*k* are received, and received radio wave strengths thereof are detected.

Next, the controller 2 measures, for each of the wireless speakers 1-*a* to 1-*k* from which the beacon signals have been received, a delay period until an audio signal output from the wireless speaker 1 reaches the controller 2 (listening position of listener) and an input-to-output ratio of a signal level (Step S11*a* to Step S11*k*). Specifically, the controller 2 transmits a test instruction containing an output time and an output level to the wireless speaker 1 (Step S110). In response to this instruction, the wireless speaker 1 outputs a test signal, which is a predetermined audio signal, at the output level designated in the test instruction at the output time designated in the test instruction Step S111). The controller 2 collects a sound of the test signal output from the wireless speaker 1 by an internal microphone, and detects an input time and an input level of the test signal into the microphone. Then, the controller 2 measures a delay period (input time-output time), which is a difference between the output time designated in the test instruction and the input time of the test signal into the microphone, and measures an input-to-output ratio (input level/output level), which is a ratio of the input level of the test signal into the microphone to the output level designated in the test instruction (Step S112). This processing (Step S110 to Step S112) is sequentially executed for each of the wireless speakers 1-*a* to 1-*k* from which the beacon signals have been received.

Then, the controller 2 identifies the wireless speakers 1-*a* to 1-*d* installed in the room A accommodating the listener with the controller 2 based on the input-to-output ratios of the wireless speakers 1-*a* to 1-*k* from which the beacon signals have been received, and groups those wireless speakers 1-*a* to 1-*d* as the wireless speakers 1 configured to output an audio signal of the same music data (Step S12). Test signals from the wireless speakers 1-*e* to 1-*k* installed in the other rooms (room B to room D) are input to the microphone of the controller 2 through, for example, a wall, and thus those signals attenuate more rapidly than test signals from the wireless speakers 1-*a* to 1-*d* installed in the same room (room A). In view of this, for example, the wireless speakers 1 having an input-to-output ratio for which a ratio of the input-to-output ratio to a reference ratio being a maximum input-to-output ratio (input-to-output ratio/reference ratio) is equal to or larger than a predetermined value (e.g., 0.9) are grouped as the wireless speakers 1 installed in the same room.

Next, the controller 2 uses the delay periods and the input-to-output ratios of the test signals from the grouped wireless speakers 1-*a* to 1-*d* to determine the output characteristics of those wireless speakers 1-*a* to 1-*d* (Step S13). For example, the controller 2 sets, for each wireless speaker 1, a value (delay period-reference period) obtained by subtracting a reference period being the maximum delay period from the delay period as an output timing (output adjustment time) of the audio signal of music data played back by the wireless speaker 1. Further, the controller 2 sets, for each wireless speaker 1, a value obtained by dividing the reference ratio being the maximum input-to-output ratio by the input-to-output ratio (reference ratio/input-to-output ratio) and multiplying the quotient by the output level designated in the test instruction, as an output level of the audio signal of music data played back by the wireless speaker 1.

Next, the controller 2 transmits an output adjustment instruction containing designation of the output timing and output level determined as described above to each of the grouped wireless speakers 1-*a* to 1-*d* (Step S14).

In response to this, the wireless speakers 1-*a* to 1-*d* adjust the output characteristics of the audio signal of music data (Step S15*a* to Step S15*d*). Specifically, the wireless speakers 1-*a* to 1-*d* make an adjustment to buffer the audio signal of played back music data, delay output of the audio signal by the output timing designated in the output adjustment instruction, and output the audio signal at the output level designated in the output adjustment instruction.

Next, the controller 2 selects two wireless speakers 1 from among the grouped wireless speakers 1-*a* to 1-*d*, and sets those wireless speakers 1 as first and second wireless speakers. For example, the controller 2 selects two wireless speakers 1 in descending order of the received radio wave strength of beacon signals, and sets those wireless speakers 1 as the first and second wireless speakers. In this description, it is assumed that the wireless speaker 1-*a* with the highest received radio wave strength of a beacon signal is set as the first wireless speaker, and the wireless speaker 1-*b* with the second highest received radio wave strength of a beacon signal is set as the second wireless speaker. The controller 2 transmits a radio wave detection instruction containing designation of an ID of the wireless speaker 1-*b* set as the second wireless speaker to the wireless speaker 1-*a* set as the first wireless speaker (Step S16).

When the first wireless speaker 1-*a* receives the radio wave detection instruction from the controller 2, the first wireless speaker 1-*a* receives a beacon signal including designation of the ID of the second wireless speaker 1-*b* designated in the radio wave detection instruction, and detects a received radio wave strength Wab thereof (Step S17). Then, the first wireless speaker 1-*a* transmits received radio wave information including the detected received radio wave strength to the controller 2 (Step S18).

When the controller 2 receives the received radio wave information from the first wireless speaker 1-*a*, the controller 2 uses the received radio wave strength (received radio wave strength Wab of beacon signal of second wireless speaker 1-*b* detected by first wireless speaker 1-*a*) included in the received radio wave information, a received radio wave strength Wa of a beacon signal of the first wireless speaker 1-*a* detected by the controller 2, and a received radio wave strength Wb of a beacon signal of the second wireless speaker 1-*b* to determine a reference coordinate system for identifying installation positions of the grouped wireless speakers 1-*a* to 1-*d* (Step S19).

FIG. 5(A) and FIG. 5(B) are diagrams for illustrating a method of determining the reference coordinate system for identifying the installation position of the wireless speaker 1.

First, as illustrated in FIG. 5(A), the controller 2 sets, as a reference strength S, one of the received radio wave strengths of beacon signals of the first and second wireless speakers 1-*a* and 1-*b* detected by the controller 2 (received radio wave strength Wa of beacon signal of first wireless speaker 1-*a* in this case). Next, the controller 2 divides the reference strength S by the received radio wave strength Wa of a beacon signal of the first wireless speaker 1-*a* detected by the controller 2, and sets its result S/Wa as a distance between the controller 2 and the first wireless speaker 1-*a*. Further, the controller 2 divides the reference strength S by the received radio wave strength Wb of a beacon signal of the wireless speaker 1-*b* detected by the controller 2, and sets its result S/Wb as a distance between the controller 2 and the second wireless speaker 1-*b*. Further, the controller 2 divides the reference strength S by the received radio wave strength Wab of a beacon signal of the second wireless speaker 1-*b* detected by the first wireless speaker 1-*a*, and sets its result S/Wab as a distance between the first wireless speaker 1-*a* and the second wireless speaker 1-*b*. Then, the controller 2 uses the distance S/Wa between the controller 2 and the first wireless speaker 1-*a*, the distance S/Wb between the controller 2 and the second wireless speaker 1-*b*, and the distance S/Wab between the first wireless speaker 1-*a* and the second wireless speaker 1-*b* to identify relative positions of the controller 2, the first wireless speaker 1-*a*, and the second wireless speaker 1-*b*, and acquires interior angles (interior angle $\alpha$ at vertex corresponding to controller 2, interior angle $\beta$ at vertex corresponding to first wireless speaker 1-*a*, and interior angle $\gamma$ at vertex corresponding to second wireless speaker 1-*b*) of a triangle having those relative positions as its vertices.

Next, as illustrated in FIG. 5(B), the controller 2 sets the position of the controller 2 as an origin (0, 0). Then, the controller 2 sets the side of the first wireless speaker 1-*a* as a positive side, and sets a straight line passing through the controller 2 and the first wireless speaker 1-*a* as a Y-axis to determine the reference coordinate system (XY orthogonal coordinate system). Then, the controller 2 converts the position of the first wireless speaker 1-*a* into a position (0, S/Wa) in the reference coordinate system, and converts the position of the second wireless speaker 1-*b* into a position ((S/Wb) sin $\alpha$, (S/Wb) cos $\alpha$) in the reference coordinate system.

Next, when the controller 2 determines the reference coordinate system as described above, the controller 2 transmits, to each of the first wireless speaker 1-*a* and the second wireless speaker 1-*b*, a radio wave detection instruction containing designation of IDs of the grouped wireless speakers 1-*c* and 1-*d* other than the first and second wireless speakers 1-*a* and 1-*b* (Step S20).

When the first wireless speaker 1-*a* receives the radio wave detection instruction from the controller 2, the first wireless speaker 1-*a* receives a beacon signal including the ID of the wireless speaker 1-*c* designated in the radio wave detection instruction and a beacon signal including the ID of the wireless speaker 1-*d* to detect received radio wave strengths thereof (Step S21). Then, the first wireless speaker 1-*a* transmits received radio wave information including the received radio wave strengths of beacon signals of the respective wireless speakers 1-*c* and 1-*d* to the controller 2 (Step S22).

When the second wireless speaker 1-*b* receives the radio wave detection instruction from the controller 2, the second wireless speaker 1-*b* receives a beacon signal including the ID of the wireless speaker 1-*c* designated in the radio wave detection instruction and a beacon signal including the ID of the wireless speaker 1-*d* to detect received radio wave strengths thereof (Step S23). Then, the second wireless speaker 1-*b* transmits received radio wave information including the received radio wave strengths of beacon signals of the respective wireless speakers 1-*c* and 1-*d* to the controller 2 (Step S24).

When the controller 2 receives the received radio wave information from the first wireless speaker 1-*a* and the second wireless speaker 1-*b*, the controller 2 identifies the positions of the wireless speaker 1-*c* and the wireless speaker 1-*d* in the reference coordinate system based on the received radio wave strengths (received radio wave strengths Wac and Wad of beacon signals of wireless speakers 1-*c* and 1-*d* detected by first wireless speaker 1-*a*) included in the received radio wave information received from the first wireless speaker 1-*a*, the received radio wave strength (received radio wave strengths Wbc and Wbd of beacon signals of wireless speakers 1-*c* and 1-*d* detected by second wireless speaker 1-*b*) included in the received radio wave information received from the second wireless speaker 1-*b*, the received radio wave strengths We and Wd of beacon signals of the wireless speakers 1-*c* and 1-*d* detected by the controller 2, and the position of each of the controller 2, the first wireless speaker 1-*a*, and the second wireless speaker 1-*b* in the reference coordinate system. With this, the controller 2 identifies installation states of all the grouped wireless speakers 1-*a* to 1-*d* (Step S25).

FIG. 6(A) and FIG. 6(B) are diagrams for illustrating a method of identifying positions of the grouped wireless speakers 1 other than the first and second wireless speakers.

First, as illustrated in FIG. 6(A), the controller 2 divides the reference strength S used at the time of determining the reference coordinate system by the received radio wave strength Wc of a beacon signal of the wireless speaker 1-*c* detected by the controller 2, and sets its result S/Wc as a distance between the controller 2 and the wireless speaker 1-*c*. Then, the controller 2 acquires a circle Rc centered at the controller 2 with a radius of S/Wc. Further, the controller 2 divides the reference strength S by the received radio wave strength Wac of a beacon signal of the wireless speaker 1-*c* detected by the first wireless speaker 1-*a*, and sets its result S/Wac as a distance between the first wireless speaker 1-*a* and the wireless speaker 1-*c*. Then, the controller 2 acquires a circle Rac centered at the first wireless speaker 1-*a* with a radius of S/Wac. Further, the controller 2 divides the reference strength S by the received radio wave strength Wbc of a beacon signal of the wireless speaker 1-*c* detected by the second wireless speaker 1-*b*, and sets its result S/Wbc as a distance between the second wireless speaker 1-*b* and the wireless speaker 1-*c*. Then, the controller 2 acquires a circle Rbc centered at the second wireless speaker 1-*b* with a radius of S/Wbc. The controller 2 acquires an intersection among the circle Rc, the circle Rac, and the Rbc acquired described above, and sets this intersection as the position of the wireless speaker 1-*c* in the reference coordinate system.

Next, as illustrated in FIG. 6(B), the controller 2 divides the reference strength S by the received radio wave strength Wd of a beacon signal of the wireless speaker 1-*d* detected by the controller 2, and sets its result S/Wd as a distance between the controller 2 and the wireless speaker 1-*d*. Then, the controller 2 acquires a circle Rd centered at the controller 2 with a radius of S/Wd. Further, the controller 2 divides the reference strength S by the received radio wave strength Wad of a beacon signal of the wireless speaker 1-*d* detected by the first wireless speaker 1-*a*, and sets its result S/Wad as a distance between the first wireless speaker 1-*a* and the wireless speaker 1-*d*. Then, the controller 2 acquires a circle Rad centered at the first wireless speaker 1-*a* with a radius of S/Wad. Further, the controller 2 divides the reference strength S by the received radio wave strength Wbd of a beacon signal of the wireless speaker 1-*d* detected by the second wireless speaker 1-*b*, and sets its result S/Wbd as a distance between the second wireless speaker 1-*b* and the wireless speaker 1-*d*. Then, the controller 2 acquires a circle Rbd centered at the second wireless speaker 1-*b* with a radius of S/Wbd. The controller 2 acquires an intersection among the circle Rd, the circle Rad, and the Rbd acquired described above, and sets this intersection as the position of the wireless speaker 1-*d* in the reference coordinate system.

Figure 7:
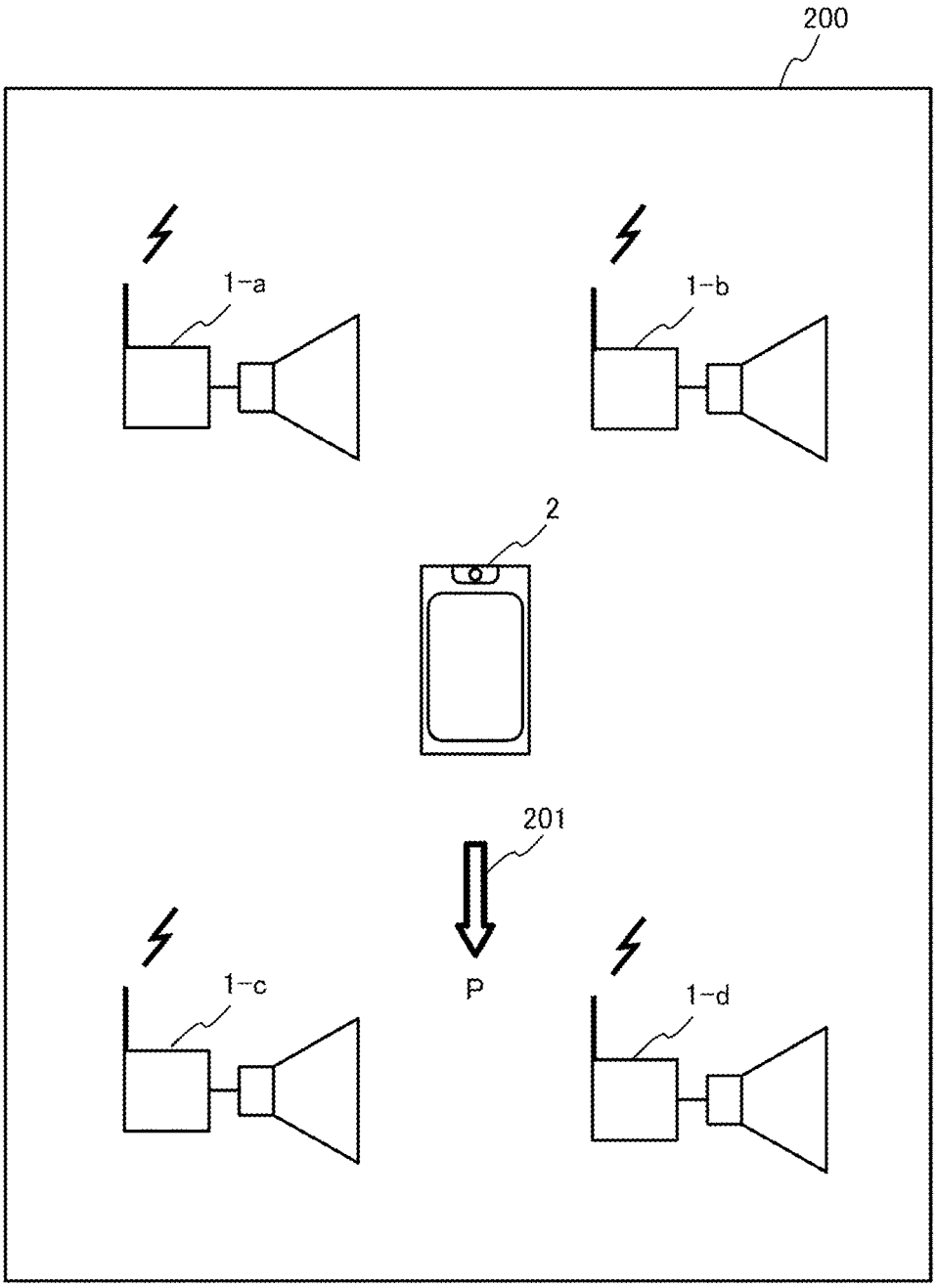
FIG. 7 is a diagram for illustrating an example of a screen for displaying installation states of a controller 2 and grouped wireless speakers 1-*a* to 1-*d*, for receiving designation of a front direction from the user.

Next, for example, as illustrated in FIG. 7, the controller 2 displays installation states (positions in reference coordinate system) of the controller 2 and the grouped wireless speakers 1-*a* to 1-*d* on a display screen 200 (Step S26), and receives designation 201 of a front direction P of the user (controller 2) from the user with the controller 2. Then, the controller 2 reflects the front direction P received from the user in the installation states of the grouped wireless speakers 1-*a* to 1-*d* (Step S27). With this, the controller 2 identifies in which of front, rear, left, and right directions of the user (controller 2) each of the grouped wireless speakers 1-*a* to 1-*d* is installed. In the example illustrated in FIG. 7, the wireless speaker 1-*a* is installed on the rear right side of the user, the wireless speaker 1-*b* is installed on the rear left side of the user, the wireless speaker 1-*c* is installed on the front right side of the user, and the wireless speaker 1-*d* is installed on the front left side of the user.

Next, the controller 2 determines the audio signal output mode of the grouped wireless speakers 1-*a* to 1-*d* based on the number of grouped wireless speakers 1-*a* to 1-*d* and the installation states of the grouped wireless speakers 1-*a* to 1-*d* in which the front direction P of the user is reflected (Step S28). For example, in the example illustrated in FIG. 7, the 4 channel mode is selected, and a rear right (RR) channel, a rear left (RL) channel, a front right (FR) channel, and a front left (FL) channel are assigned to the wireless speaker 1-*a*, the wireless speaker 1-*b*, the wireless speaker 1-*c*, and the wireless speaker 1-*d*, respectively.

Then, the controller 2 transmits an output mode setting instruction containing the audio signal output mode and the assigned channel to each of the grouped wireless speakers 1-*a* to 1-*d* (Step S29). In response to this, each of the grouped wireless speakers 1-*a* to 1-*d* sets the audio signal output mode and the assigned channel in accordance with the output mode setting instruction received from the controller 2 (Step S30*a* to Step S30*d*).

Next, details of the wireless speaker 1 and the controller 2 of the wireless audio system according to this embodiment are described.

First, the wireless speaker 1 is described.

Figure 8:
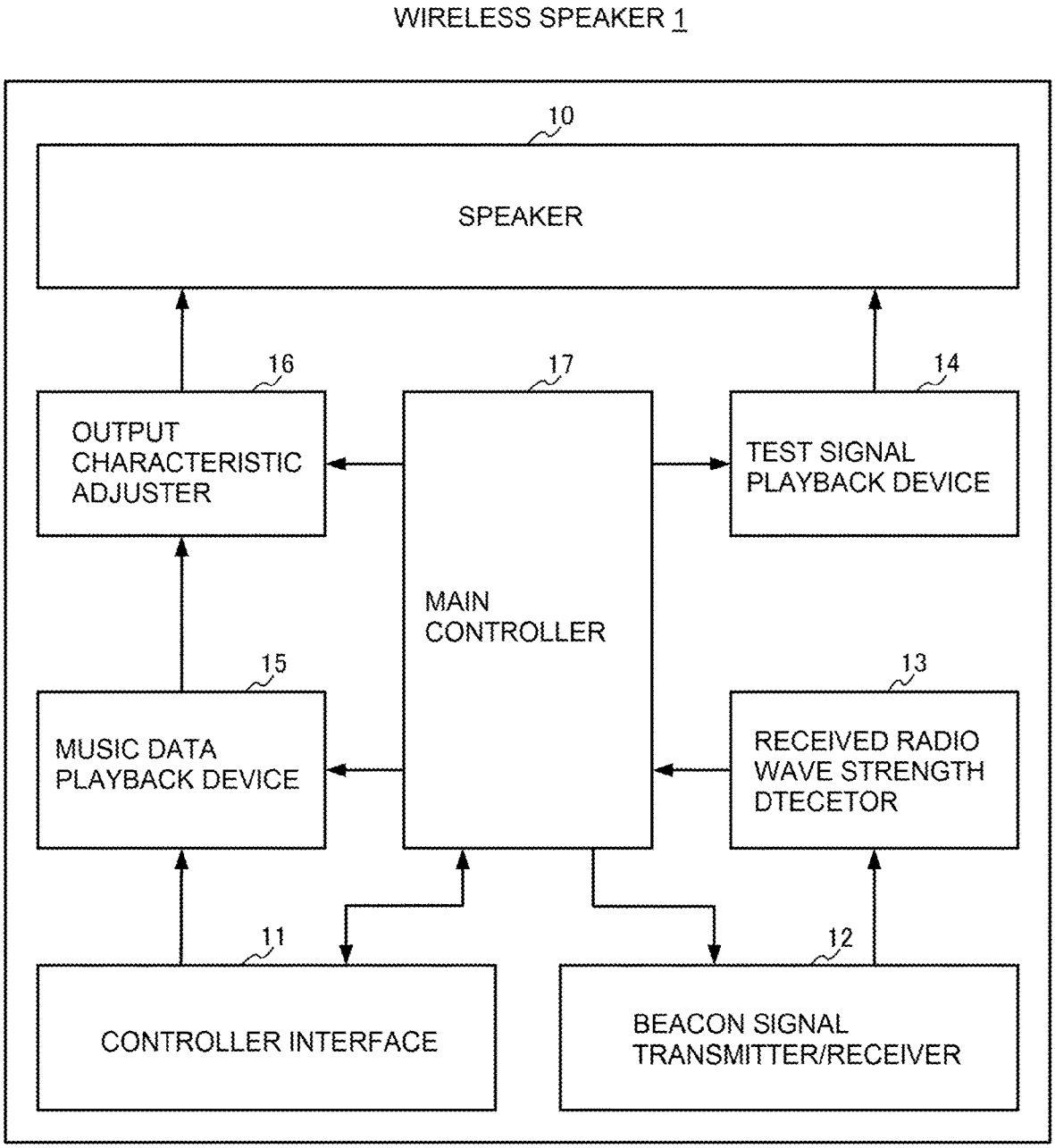
FIG. 8 is a schematic functional configuration diagram of the wireless speaker 1.

FIG. 8 is a schematic functional configuration diagram of the wireless speaker 1. A functional configuration of the wireless speaker 1 illustrated in FIG. 8 is, for example, implemented in the following manner: in a computer including a CPU, a memory, an auxiliary storage device, for example, a flash memory, a wireless communication device based on, for example, Bluetooth (trademark), and a speaker, the CPU loads a predetermined program onto the memory from the auxiliary storage device to execute the program.

As illustrated in FIG. 8, the wireless speaker 1 includes a speaker 10, a controller interface 11, a beacon signal transmitter/receiver 12, a received radio wave strength detector 13, a test signal playback device 14, a music data playback device 15, an output characteristic adjuster 16, and a main controller 17.

The controller interface 11 is an interface for communicating to/from the controller 2 in accordance with a wireless standard, for example, Bluetooth (trademark).

The beacon signal transmitter/receiver 12 is configured to periodically transmit a beacon signal including an ID, for example, a received signal strength indicator (RSSI), assigned to the own wireless speaker 1 in a wireless manner. Further, the beacon signal transmitter/receiver 12 receives a beacon signal including an ID notified by the main controller 17 in a wireless manner in accordance with an instruction from the main controller 17.

The received radio wave strength detector 13 is configured to detect a received radio wave strength of the beacon signal received by the beacon signal transmitter/receiver 12.

The test signal playback device 14 is configured to play back a test signal being a predetermined audio signal at the output time notified by the main controller 17 in accordance with an instruction from the main controller 17, and output the test signal from the speaker 10 at the output level notified by the main controller 17.

The music data playback device 15 is configured to receive music data including the ID of the own wireless speaker 1 as a destination from the controller 2 via the controller interface 11. Then, the music data playback device 15 plays back the audio signal of the music data in accordance with the audio signal output mode and the assigned channel of the own wireless speaker 1 set by the main controller 17.

The output characteristic adjuster 16 is configured to output the audio signal played back by the music data playback device 15 from the speaker 10 in accordance with output characteristics set by the main controller 17. Specifically, the output characteristic adjuster 16 buffers the audio signal by the output timing (output adjustment time) set by the main controller 17 to adjust the output timing of the audio signal from the speaker 10. Further, the output characteristic adjuster 16 adjusts the output level of the audio signal from the speaker 10 to the output level set by the main controller 17.

The main controller 17 is configured to centrally control the components 10 to 16 of the wireless speaker 1. Further, the main controller 17 causes the test signal playback device 14 to play back a test signal in accordance with an instruction received from the controller 2 via the controller interface 11, or causes the beacon signal transmitter/receiver 12 to receive a beacon signal. Further, the main controller 17 sets the audio signal output mode and the assigned channel in the music data playback device 15, and sets the output characteristics (output timing and output level) in the output characteristic adjuster 16.

Figure 9:
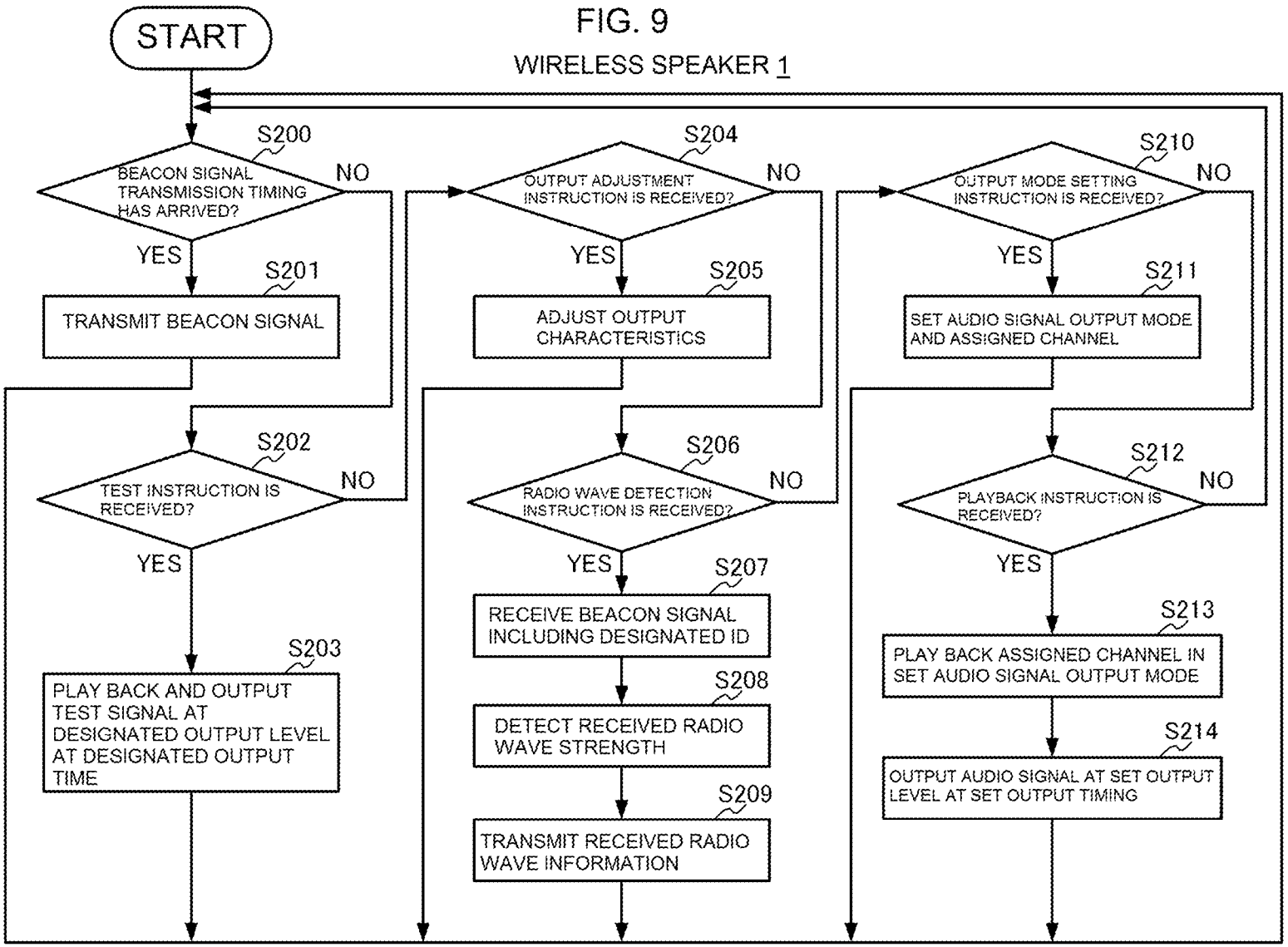
FIG. 9 is a flowchart for illustrating an operation of the wireless speaker 1.

FIG. 9 is a flowchart for illustrating an operation of the wireless speaker 1.

When a periodical beacon signal transmission timing has arrived (YES in Step S200), the beacon signal transmitter/receiver 12 transmits a beacon signal including the ID of the own wireless speaker 1 in a wireless manner (Step S201).

When the main controller 17 receives a test instruction from the controller 2 via the controller interface 11 (YES in Step S202), the main controller 17 notifies the test signal playback device 14 of the output time and output level designated in the test instruction. In response to this, the test signal playback device 14 plays back a test signal at the designated output time, and outputs the played back test signal from the speaker 10 at the designated output level (Step S203).

Further, when the main controller 17 receives an output adjustment instruction from the controller 2 via the controller interface 11 (YES in Step S204), the main controller 17 sets the output timing and output level designated in the output adjustment instruction to the output characteristic adjuster 16 (Step S205).

Further, when the main controller 17 receives a radio wave detection instruction from the controller 2 via the controller interface 11 (YES in Step S206), the main controller 17 notifies the beacon signal transmitter/receiver 12 of the ID designated in the radio wave detection instruction. In response to this, the beacon signal transmitter/receiver 12 receives a beacon signal including the ID (Step S207). Then, the received radio wave strength detector 13 detects the received radio wave strength of the beacon signal received by the beacon signal transmitter/receiver 12, and notifies the main controller 17 of the detected received radio wave strength (Step S208). In response to this, the main controller 17 generates received radio wave information including the received radio wave strength notified by the received radio wave strength detector 13 and the ID notified to the beacon signal transmitter/receiver 12. Then, the main controller 17 transmits the received radio wave information to the controller 2 via the controller interface 11 (Step S209).

Further, when the main controller 17 receives an output mode setting instruction from the controller 2 via the controller interface 11 (YES in Step S210), the main controller 17 sets the audio signal output mode and the assigned channel designated in the output mode setting instruction in the music data playback device 15 (Step S211).

When the music data playback device 15 receives a playback instruction containing the ID of the own wireless speaker 1 from the controller 2 via the controller interface 11 (YES in Step S212), the music data playback device 15 plays back the audio signal of music data included in this playback instruction in accordance with the set audio signal output mode and assigned channel (Step S213). Then, the output characteristic adjuster 16 buffers the audio signal played back by the music data playback device 15 by the set output timing (output adjustment time), and outputs the audio signal from the speaker 10 at the set output level (Step S214).

Next, the controller 2 is described.

Figure 10:
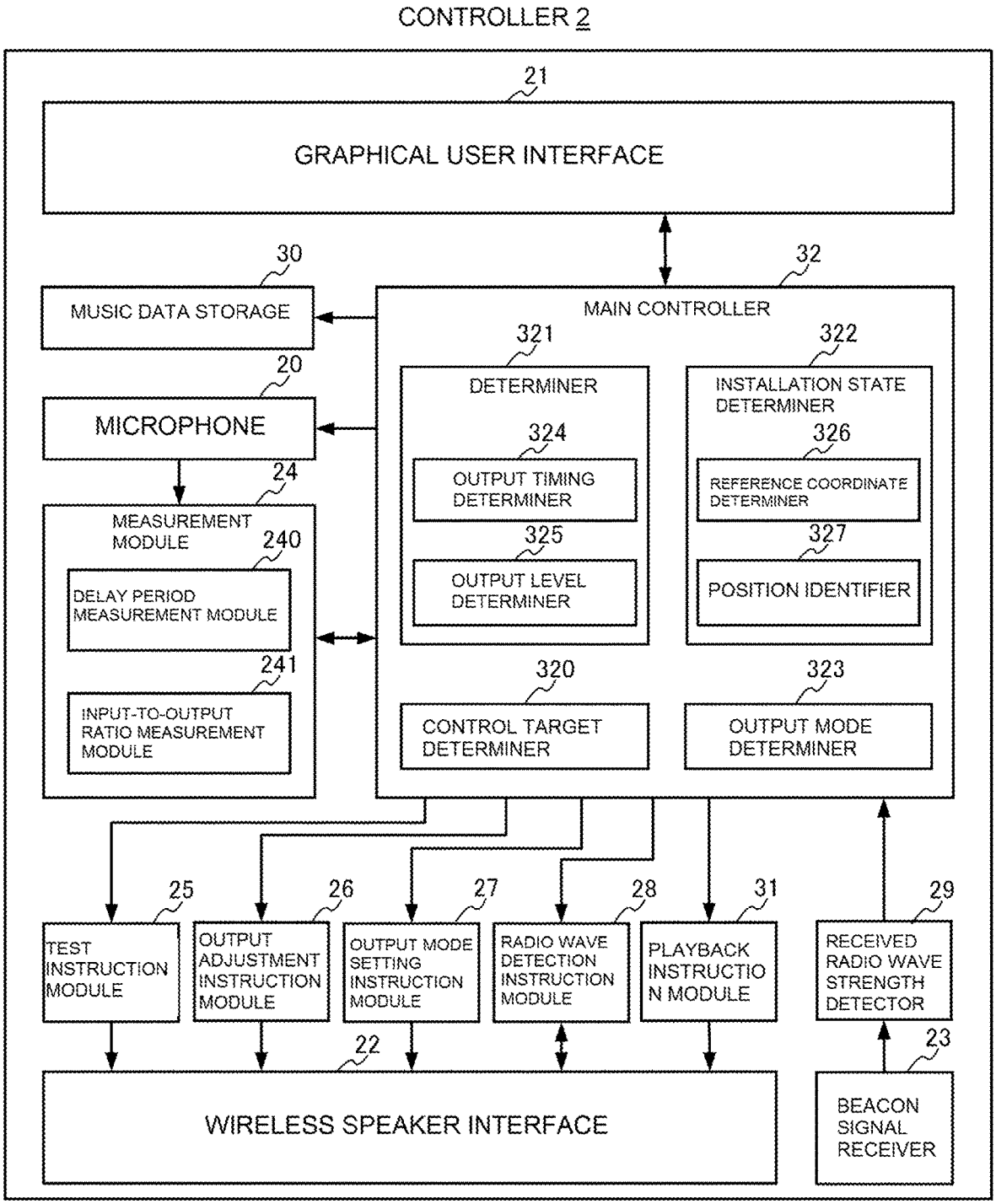
FIG. 10 is a schematic functional configuration diagram of the controller 2.

FIG. 10 is a schematic functional configuration diagram of the controller 2. The functional configuration of the controller 2 illustrated in FIG. 10 is, for example, implemented in the following manner: in a portable computer, for example, a smartphone or a tablet PC, which includes a CPU, a memory, an auxiliary storage device, for example, a flash memory, an input/output device, for example, a touch panel, a display, or a pointing device, a wireless communication device based on, for example, Bluetooth (trademark), and a microphone, the CPU loads a predetermined program onto the memory from the auxiliary storage device to execute the program.

As illustrated in FIG. 10, the controller 2 includes a microphone 20, a graphical user interface 21, a wireless speaker interface 22, a beacon signal receiver 23, a measurement module 24, a test instruction module 25, an output adjustment instruction module 26, an output mode setting instruction module 27, a radio wave detection instruction module 28, a received radio wave strength detector 29, a music data storage 30, a playback instruction module 31, and a main controller 32.

The graphical user interface 21 is an interface for displaying information or receiving various kinds of operations from the user.

The wireless speaker interface 22 is an interface for communicating to/from the wireless speaker 1 in accordance with a wireless standard, for example, Bluetooth (trademark).

The beacon signal receiver 23 is configured to receive a beacon signal including, for example, an RSSI, which is periodically transmitted from the wireless speaker 1, in a wireless manner.

The measurement module 24 is configured to measure signal characteristics of a test signal output from the wireless speaker 1 and input to the microphone 20, and includes a delay period measurement module 240 and an input-to-output ratio measurement module 241.

The delay period measurement module 240 is configured to measure a delay period (input time-output time), which is a difference between the input time of a test signal into the microphone 20 and the output time of the test signal from the wireless speaker 1 notified by the main controller 32.

The input-to-output ratio measurement module 241 is configured to measure an input-to-output ratio (input level/output level), which is a ratio of the input level of a test signal input to the microphone 20 to the output level of the test signal from the wireless speaker 1 notified by the main controller 32.

The test instruction module 25 is configured to transmit a test instruction containing designation of the output time and the output level to the wireless speaker 1 via the wireless speaker interface 22.

The output adjustment instruction module 26 is configured to transmit an output adjustment instruction containing designation of the output timing and the output level to the wireless speaker 1 via the wireless speaker interface 22.

The output mode setting instruction module 27 is configured to transmit an output mode setting instruction containing designation of the audio signal output mode and the assigned channel to the wireless speaker 1 via the wireless speaker interface 22.

The radio wave detection instruction module 28 is configured to transmit a radio wave detection instruction containing designation of the ID of the wireless speaker 1, which is a transmission source of a beacon signal to be received by the controller 2, to the wireless speaker 1 via the wireless speaker interface 22. Further, the radio wave detection instruction module 28 is configured to receive, from the wireless speaker 1 to which the radio wave detection instruction has been transmitted, received radio wave information including the received radio wave strength of a beacon signal and the ID of the wireless speaker 1 having transmitted the beacon signal.

The received radio wave strength detector 29 is configured to detect the received radio wave strength of a beacon signal received by the beacon signal receiver 23, and notify the main controller 32 of the detected received radio wave strength together with the ID of the wireless speaker 1 assigned to the beacon signal.

The music data storage 30 stores music data.

The playback instruction module 31 is configured to transmit a playback instruction containing music data received from the main controller 32 and the ID of the wireless speaker 1 from the wireless speaker interface 22.

The main controller 32 is configured to centrally control the components 20 to 31 of the controller 2. The main controller 32 includes a control target determiner 320, a determiner 321, an installation state determiner 322, and an output mode determiner 323.

The control target determiner 320 is configured to determine, for each wireless speaker 1, whether the wireless speaker 1 is installed in a room accommodating the user with the controller 2 based on the input-to-output ratio of the test signal of the wireless speaker 1 measured by the measurement module 24. Then, the control target determiner 320 groups the wireless speakers 1, which are determined to be installed in the room accommodating the user with the controller 2, as control targets.

The determiner 321 is configured to determine the audio signal output characteristics of the wireless speakers 1 grouped by the control target determiner 320 based on a result of measurement by the measurement module 24, and includes an output timing determiner 324 and an output level determiner 325.

The output timing determiner 324 is configured to determine the output timings (output adjustment time) of the respective wireless speakers 1 based on the delay periods of test signals measured by the measurement module 24 for the wireless speakers 1 grouped by the control target determiner 320 so that, for example, audio signals output from those wireless speakers 1 reach the controller 2 at the same timing.

The output level determiner 325 is configured to determine the output levels of the respective wireless speakers 1 based on the input-to-output ratios of test signals measured by the measurement module 24 for the wireless speakers 1 grouped by the control target determiner 320 so that, for example, audio signals output from those wireless speakers 1 reach the controller 2 at the same volume level.

The installation state determiner 322 is configured to determine the installation states of the wireless speakers 1 grouped by the control target determiner 320, and includes a reference coordinate determiner 326 and a position identifier 327.

The reference coordinate determiner 326 is configured to identify relative positions of the controller 2 and the first and second wireless speakers 1 based on received radio wave strengths of beacon signals detected by the received radio wave strength detector 29 for the first and second wireless speakers 1 selected from among the grouped wireless speakers 1 and the received radio wave strength of a beacon signal of the second wireless speaker 1 detected by the first wireless speaker 1. Then, the reference coordinate determiner 326 determines the reference coordinate system based on the identified relative positions (refer to FIG. 5).

Figure 6:
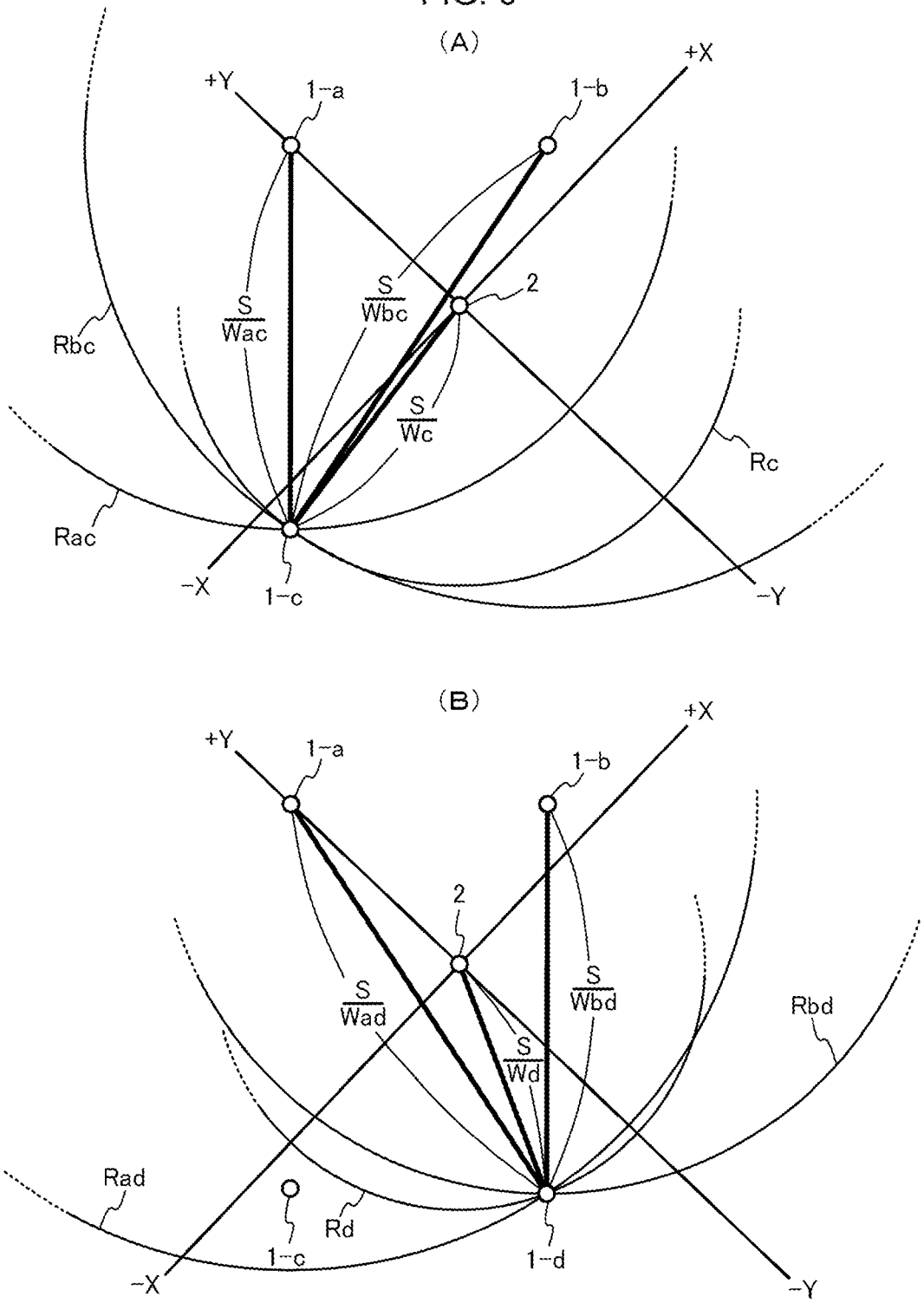
FIG. 6(A) and FIG. 6(B) are diagrams for illustrating a method of identifying positions of the grouped wireless speakers 1 other than the first and second wireless speakers.

The position identifier 327 is configured to identify information on positions of the respective wireless speakers 1 other than the first and second wireless speakers 1 in the reference coordinate system based on the received radio wave strengths of beacon signals detected by the received radio wave strength detector 29 for the wireless speakers 1 other than the first and second wireless speakers 1 among the grouped wireless speakers 1, the received radio wave strengths of beacon signals of the other wireless speakers 1 in the group detected by the first and second wireless speakers 1, and information on positions of the controller 2 and the first and second wireless speakers 1 in the reference coordinate system (refer to FIG. 6).

The output mode determiner 323 is configured to determine the audio signal output mode of the grouped wireless speakers 1 and the assigned channels of the respective wireless speaker 1 based on the installation states of the grouped wireless speakers 1 determined by the installation state determiner 322, and the front direction (refer to FIG. 7) of the user received from the user via the graphical user interface 21.

Figure 11:
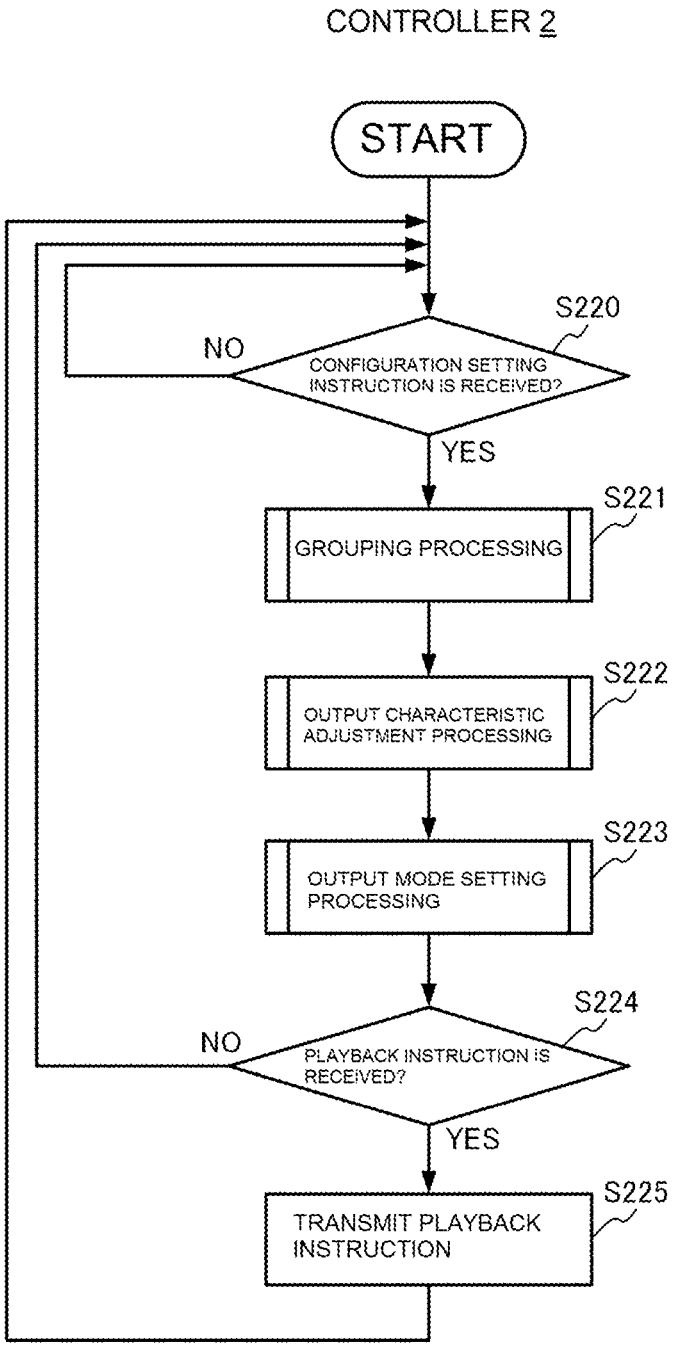
FIG. 11 is a flowchart for illustrating an operation of the controller 2.

FIG. 11 is a flowchart for illustrating an operation of the controller 2.

First, when the main controller 32 receives, from the user via the graphical user interface 21, a configuration setting instruction for the wireless speaker 1 configured to play back/output an audio signal of music data (YES in Step S220), the main controller 32 executes grouping processing described later to group the wireless speakers 1, which are installed in a room accommodating the user with the controller 2, into the wireless speakers 1 configured to play back/output an audio signal of the same music data (Step S221). Next, the main controller 32 executes output characteristic adjustment processing described later to adjust the output characteristics (output timing and output level) of the respective grouped wireless speakers 1 (Step S222). Then, the main controller 32 executes output mode setting processing described later to set the audio signal output mode for the grouped wireless speakers 1 and the assigned channels of those respective wireless speakers 1 (Step S223).

After the output characteristics of the grouped wireless speakers 1 are adjusted and the audio signal output mode and the assigned channels are set, when the main controller 32 receives a playback instruction containing designation of music data from the user via the graphical user interface 21 (YES in Step S224), the main controller 32 reads the music data from the music data storage 30, and passes the music data to the playback instruction module 31 together with the ID of each of the grouped wireless speakers 1. In response to this, the playback instruction module 31 transmits a playback instruction containing the music data and the ID of each of the grouped wireless speakers 1, which are received from the main controller 32, from the wireless speaker interface 22 (Step S225).

Figure 12:
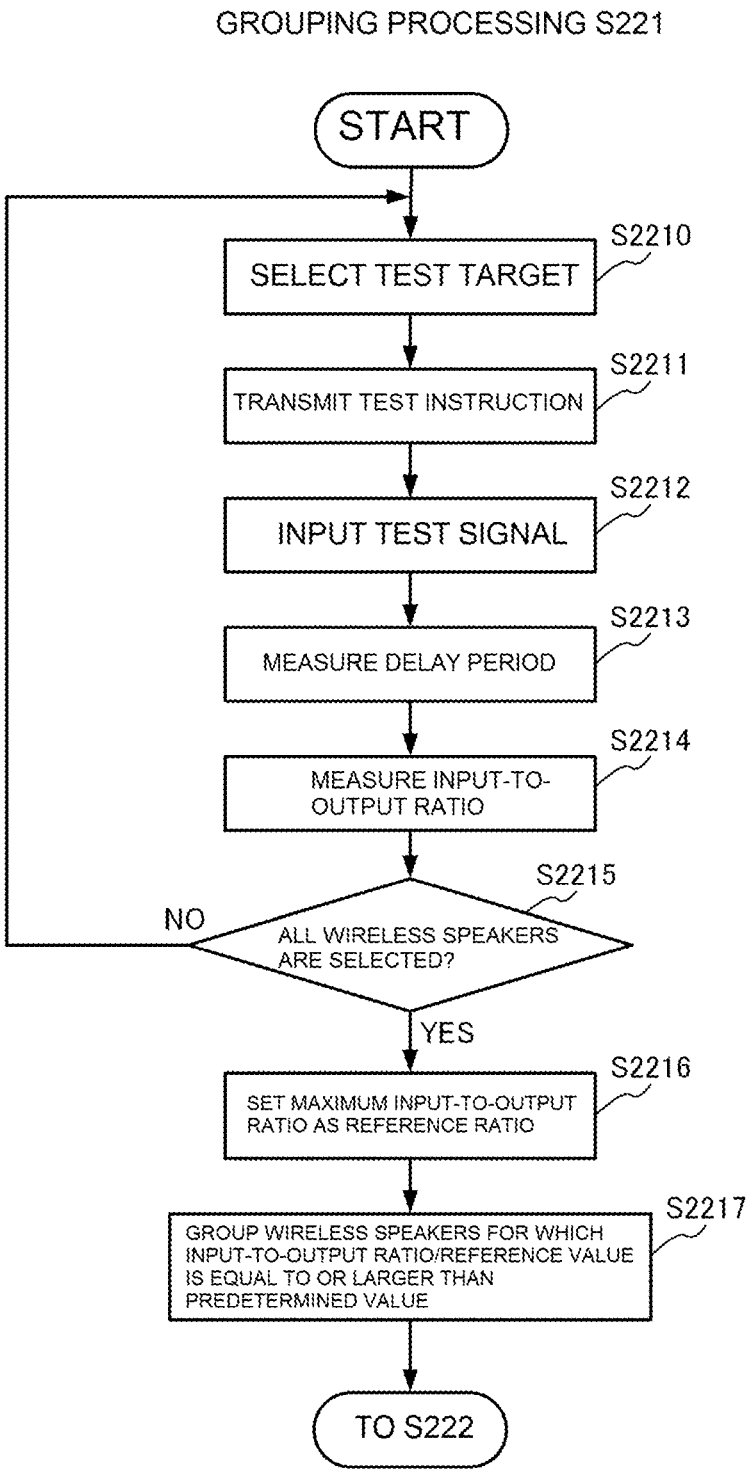
FIG. 12 is a flowchart for illustrating grouping processing (Step S221) illustrated in FIG. 11.

FIG. 12 is a flowchart for illustrating the grouping processing (Step S221) illustrated in FIG. 11.

First, the control target determiner 320 of the main controller 32 acquires the received radio wave strengths of beacon signals received by the beacon signal receiver 23 from the received radio wave strength detector 29 together with the IDs of the wireless speakers 1 assigned to the beacon signals, to thereby recognize the wireless speakers 1, which may communicate to/from the own wireless speaker 1. Then, the control target determiner 320 selects one unselected wireless speaker 1 as a test target from the wireless speakers 1, which may communicate to/from the own wireless speaker 1 (Step S2210).

Next, the control target determiner 320 notifies the test instruction module 25 of the ID of the wireless speaker 1 selected as the test target together with an output level determined in advance and an output time, which is set to a time a predetermined time period after the current time, and enables the microphone 20. In response to this, the test instruction module 25 transmits, from the wireless speaker interface 22, a test instruction containing designation of the ID of the wireless speaker 1, the output time, and the output level, which are notified by the control target determiner 320 (Step S2211). As a result, the wireless speaker 1 with the ID designated in the test instruction outputs a test signal at the output level designated in the test instruction at the output time designated in the test instruction. Then, the test signal is input to the microphone 20 (Step S2212).

Next, the delay period measurement module 240 of the measurement module 24 measures a delay period (input time-output time), which is a different between an output time designated in the test instruction and an input time of the test signal into the microphone 20 (Step S2213), and measures an input-to-output ratio (input level/output level), which is a ratio of the input level of a test signal into the microphone 20 to the output level designated in the test instruction (Step S2214), to notify the delay period and the input-to-output ratio to the control target determiner 320. In response to this, the control target determiner 320 stores the delay period and the input-to-output ratio in association with the ID of the wireless speaker 1 designated in the test instruction.

Next, the control target determiner 320 determines whether all the wireless speakers 1, which may communicate to/from the own wireless speaker 1 are selected as test targets (Step S2215). When there is a wireless speaker 1 unselected as a test target (NO in Step S2215), the processing returns to Step S2210.

On the contrary, when all the wireless speakers 1, which may communicate to/from the own wireless speaker 1 are selected as test targets (YES in Step S2215), the control target determiner 320 sets a maximum input-to-output ratio among the input-to-output ratios received from the input-to-output ratio measurement module 241 as a reference ratio (Step S2216). Then, the control target determiner 320 acquires a ratio (input-to-output ratio/reference ratio) of each input-to-output ratio received from the input-to-output ratio measurement module 241 to the reference ratio, and groups the wireless speakers 1 with IDs associated with input-to-output ratios for which the ratio is equal to or larger than a predetermined value (e.g., 0.9) (Step S2217). After that, the processing proceeds to the output characteristic adjustment processing illustrated in FIG. 11 (Step S222).

Figure 13:
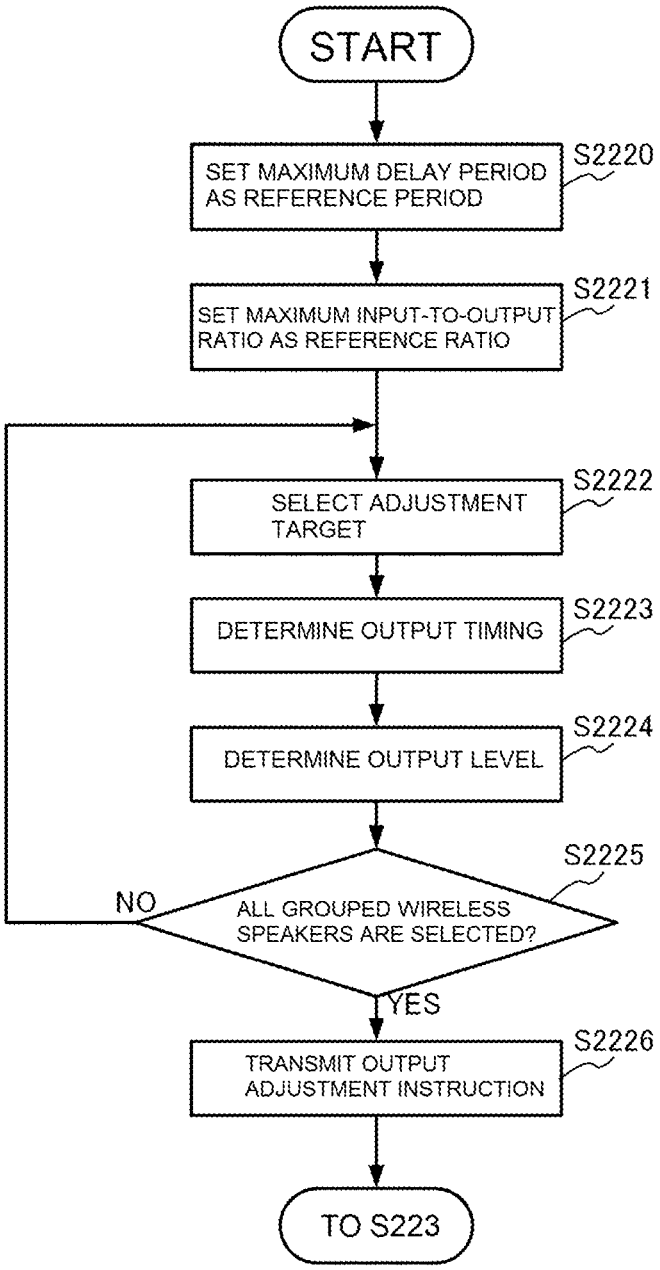
FIG. 13 is a flowchart for illustrating output characteristic adjustment processing (Step S222) illustrated in FIG. 11.

FIG. 13 is a flowchart for illustrating the output characteristic adjustment processing (Step S222) illustrated in FIG. 11.

First, the output timing determiner 324 of the determiner 321 of the main controller 32 sets, as a reference period, a maximum delay period among the delay periods (input time-output time) measured by the delay period measurement module 240 of the measurement module 24 for the respective wireless speakers 1 grouped by the control target determiner 320 (Step S2220). Further, the output level determiner 325 of the determiner 321 sets, as a reference ratio, a maximum input-to-output ratio among the input-to-output ratios (output level/input level) measured by the input-to-output ratio measurement module 241 of the measurement module 24 for the respective grouped wireless speakers 1 (Step S2221).

Next, the determiner 321 selects an unselected wireless speaker 1 as an adjustment target from the grouped wireless speakers 1 (Step S2222).

Next, the output timing determiner 324 calculates a difference (reference period-delay period) between the reference period and a delay period measured by the delay period measurement module 240 for the wireless speaker 1 selected as an adjustment target, and determines the difference as an output timing (output adjustment time) of the wireless speaker 1 selected as an adjustment target (Step S2223). Further, the output level determiner 325 determines a value obtained by dividing the reference ratio by the input-to-output ratio measured by the input-to-output ratio measurement module 241 for the wireless speaker 1 selected as an adjustment target and multiplying the quotient (reference ratio/input-to-output ratio) by the output level designated in the test instruction, as an output level of the wireless speaker 1 selected as an adjustment target (Step S2224).

Next, when there is a wireless speaker 1 unselected as an adjustment target among the grouped wireless speakers 1 (NO in Step S2225), the processing returns to Step S2222. On the contrary, when all the grouped wireless speakers 1 are selected as adjustment targets (YES in Step S2225), the determiner 321 notifies, for each of the grouped wireless speakers 1, the output adjustment instruction module 26 of the output timing and the output level of the wireless speaker 1 together with the ID of the wireless speaker 1.

In response to this, the output adjustment instruction module 26 generates, for each of the grouped wireless speakers 1, an output adjustment instruction containing the ID, the output timing, and the output level of the wireless speaker 1, and transmits the output adjustment instruction from the wireless speaker interface 22 (Step S2226).

Figure 14:
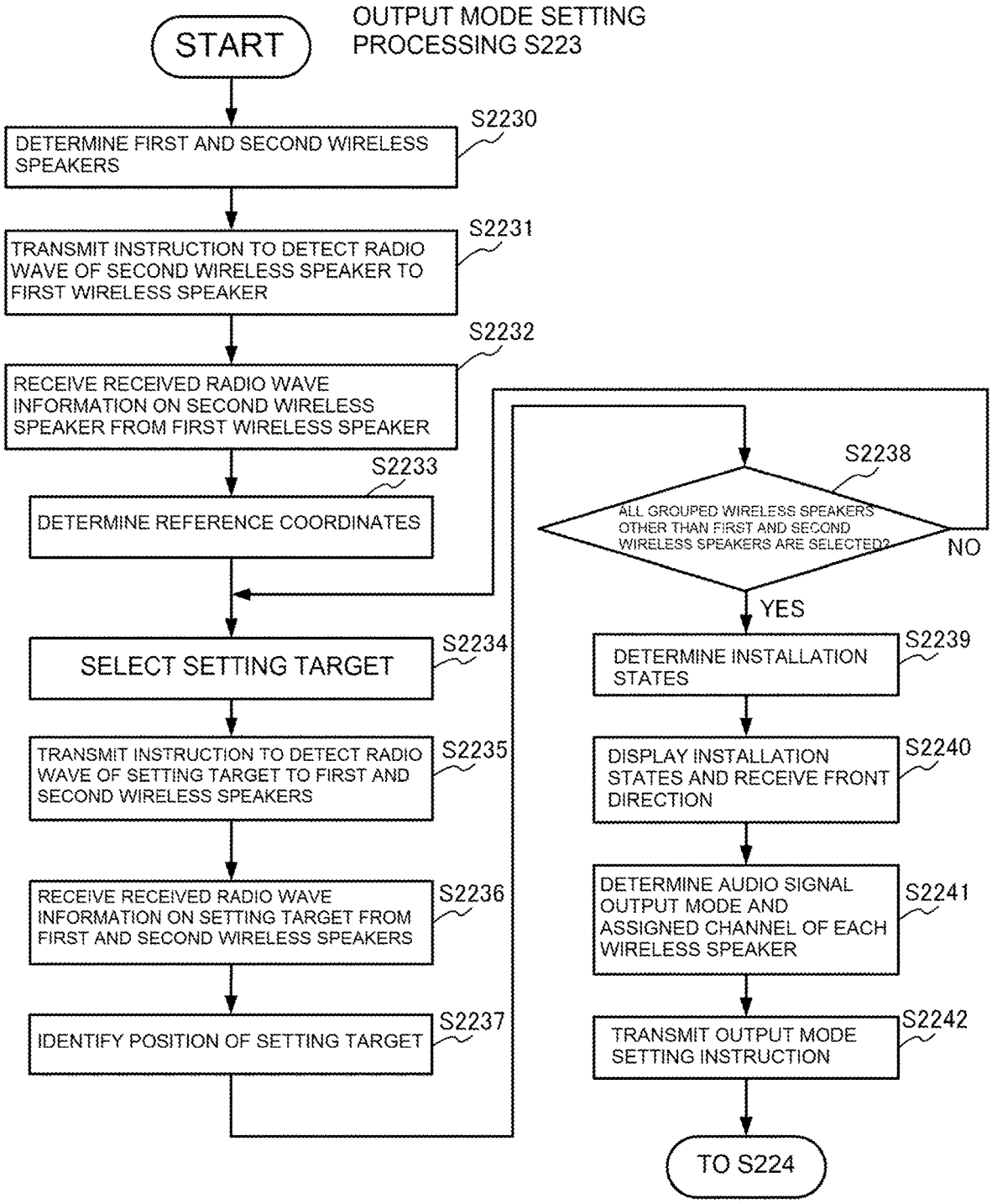
FIG. 14 is a flowchart for illustrating output mode setting processing (Step S223) illustrated in FIG. 11.

FIG. 14 is a flowchart for illustrating the output mode setting processing (Step S223) illustrated in FIG. 11.

First, the reference coordinate determiner 326 of the installation state determiner 322 of the main controller 32 determines, for each of the wireless speakers 1 grouped by the control target determiner 320, the first and second wireless speakers 1 based on the received radio wave strengths of beacon signals detected by the received radio wave strength detector 29 (Step S2230). For example, the reference coordinate determiner 326 sets the wireless speaker 1 of the strongest received radio wave strength as the first wireless speaker 1, and sets the second strongest received radio wave strength as the second wireless speaker 1.

Next, the reference coordinate determiner 326 notifies the radio wave detection instruction module 28 of the ID of the first wireless speaker 1 as the ID of a detector and the ID of the second wireless speaker 1 as the ID of a detection target. In response to this, the radio wave detection instruction module 28 transmits, from the wireless speaker interface 22, a radio wave detection instruction containing the ID of the first wireless speaker 1 as the ID of a detector and the ID of the second wireless speaker 1 as the ID of a detection target (Step S2231). Then, the radio wave detection instruction module 28 receives, from the first wireless speaker 1, received radio wave information including the received radio wave strength of a beacon signal of the second wireless speaker 1 detected by the first wireless speaker 1 (Step S2232).

Figure 5:
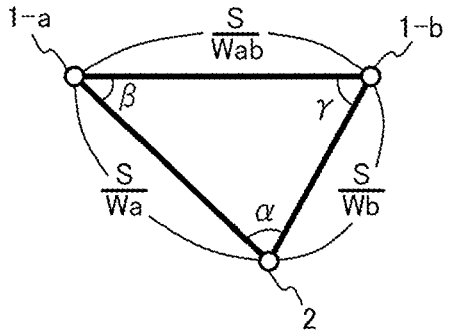
FIG. 5(A) and FIG. 5(B) are diagrams for illustrating a method of determining a reference coordinate system for identifying an installation position of a wireless speaker 1.
Figure 5:
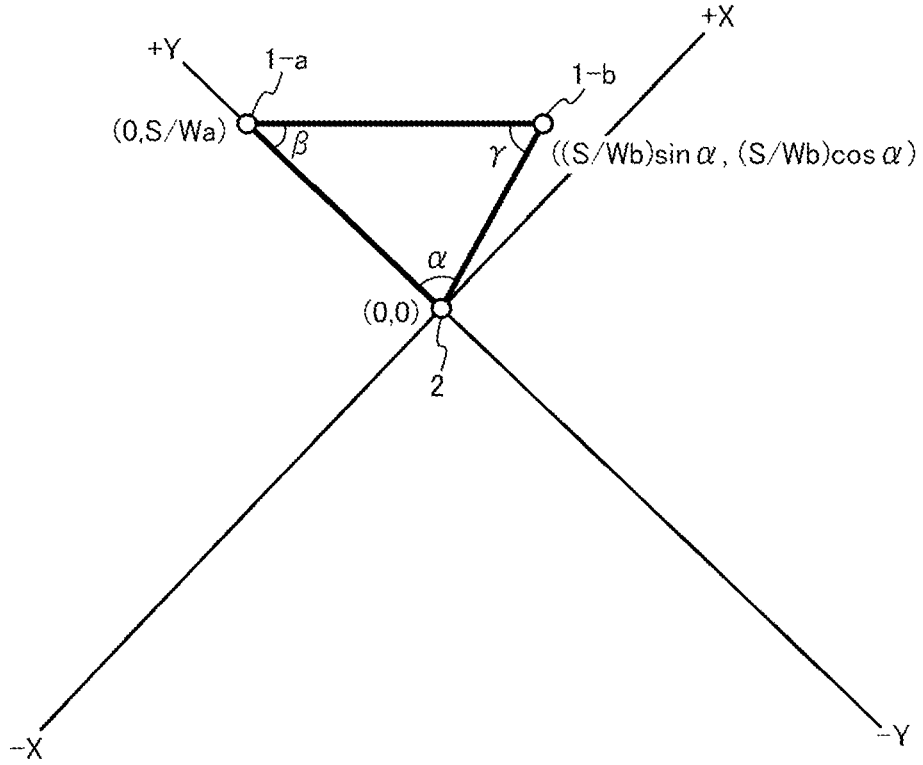

Next, the reference coordinate determiner 326 determines the reference coordinate system in the manner described with reference to FIG. 5 based on the received radio wave strengths of beacon signals of the respective first and second wireless speakers 1 detected by the received radio wave strength detector 29 and the received radio wave strength (received radio wave strength of beacon signal of second wireless speaker 1 detected by first wireless speaker 1) included in the received radio wave information received from the first wireless speaker 1, and identifies the positions of the controller 2 and the first and second wireless speakers 1 in the reference coordinate system (Step S2233).

Next, the position identifier 327 of the installation state determiner 322 selects, as a setting target, the unselected wireless speaker 1 other than the first and second wireless speakers 1 from the grouped wireless speakers 1 (Step S2234).

Next, the position identifier 327 notifies the radio wave detection instruction module 28 of the IDs of the first and second wireless speakers as the IDs of detectors and the ID of the wireless speaker 1 selected as a setting target as the ID of a detection target. In response to this, the radio wave detection instruction module 28 transmits, from the wireless speaker interface 22, a radio wave detection instruction containing the IDs of the first and second wireless speakers 1 as the IDs of detectors and the ID of the wireless speaker 1 selected as a setting target as the ID of a detection target (Step S2235). Then, the radio wave detection instruction module 28 receives, from the first wireless speaker 1, received radio wave information including the received radio wave strength of a beacon signal of the wireless speaker 1 selected as a setting target, which is detected by the first wireless speaker 1, and receives, from the second wireless speaker 1, received radio wave information including the received radio wave strength of a beacon signal of the wireless speaker 1 selected as a setting target, which is detected by the second wireless speaker 1 (Step S2236).

Next, the position identifier 327 identifies the position of the wireless speaker 1 selected as a setting target in the reference coordinate system in the manner described with reference to FIG. 6 based on the received radio wave strength of a beacon signal of the wireless speaker 1 selected as a setting target, which is detected by the received radio wave strength detector 29, the received radio wave strength (received radio wave strength of beacon signal of wireless speaker 1 selected as setting target, which is detected by first wireless speaker 1) included in the received radio wave information received from the first wireless speaker 1, the received radio wave strength (received radio wave strength of beacon signal of wireless speaker 1 selected as setting target, which is detected by second wireless speaker 1) included in the received radio wave information received from the second wireless speaker 1, and positions of the controller 2 and the first and second wireless speakers 1 in the reference coordinate system (Step S2237).

Next, when there is a wireless speaker 1 unselected as a setting target other than the first and second wireless speakers 1 among the grouped wireless speakers 1 (NO in Step S2238), the position identifier 327 returns to Step S2234. On the contrary, when all the grouped wireless speakers 1 other than the first and second wireless speakers are already selected as setting targets (YES in Step S2238), it means that the positions of all the grouped wireless speakers 1 including the first and second wireless speakers 1 in the reference coordinate system have been identified. The installation state determiner 322 determines the installation states (relative position of each of grouped wireless speakers 1 with respect to controller 2) of the grouped wireless speakers 1 based on the position of the controller 2 in the reference coordinate system and the positions of all the grouped wireless speakers 1 in the reference coordinate system (Step S2239). Then, the installation state determiner 322 passes the determined installation states to the output mode determiner 323.

The output mode determiner 323 displays the installation states of the grouped wireless speakers 1, which are received from the installation state determiner 322, on the graphical user interface 21 (refer to FIG. 7), and receives designation of a front direction of the user (controller 2) from the user with the controller 2 (Step S2240).

Next, the output mode determiner 323 reflects the front direction received from the user in the installation states of the grouped wireless speakers. With this, the output mode determiner 323 identifies in which of front, rear, left, and right directions of the user (controller 2) each of the grouped wireless speakers 1 is installed.

Next, the output mode determiner 323 determines the audio signal output mode of the grouped wireless speakers 1 and the assigned channels of those respective wireless speakers 1 based on the number of grouped wireless speakers land the installation states in which the front direction of the user is reflected (Step S2241). Then, the output mode determiner 323 notifies the output mode setting instruction module 27 of the audio signal output mode of the grouped wireless speakers 1 and the assigned channels of those respective wireless speakers 1 together with the IDs of those respective wireless speakers 1.

In response to this, the output mode setting instruction module 27 transmits, from the wireless speaker interface 22, an output mode setting instruction containing the audio signal output mode notified by the output mode determiner 323 and the assigned channel associated with the ID for each of the grouped wireless speakers 1 and having each of the grouped wireless speakers 1 as its destination (Step S2242). After that, the processing proceeds to Step S224 of FIG. 11.

In the above, the first embodiment of the present invention has been described.

In this embodiment, the controller 2 causes the microphone 20 of the controller 2 held by the listener to collect the sound of a test signal output from the wireless speaker 1, and performs, for each of the plurality of wireless speakers 1 configured to output an audio signal of the same music data, processing of measuring the delay period, which is a difference between the output time of a test signal from the wireless speaker 1 and the input time of the test signal into the microphone 20. Then, the output timing (output adjustment time) of each wireless speaker 1 is adjusted based on the delay period of an audio signal of each wireless speaker 1. Therefore, for example, it is possible to adjust each wireless speaker 1 so that an audio signal output from the wireless speaker 1 reaches a listening position at the same timing and becomes an optimal audio signal at the listening position.

Further, in this embodiment, the controller 2 causes the microphone 20 of the controller 2 held by the listener to collect the sound of a test signal output from the wireless speaker 1, and performs, for each of the plurality of wireless speakers 1 configured to output an audio signal of the same music data, processing of measuring the input-to-output ratio, which is a ratio of the input level of a test signal into the microphone 20 to the output level of the test signal from the wireless speaker 1. Then, the output level of each wireless speaker 1 is adjusted based on the input-to-output ratio of an audio signal of each wireless speaker 1. Therefore, for example, it is possible to adjust each wireless speaker 1 so that an audio signal output from the wireless speaker 1 exhibits the same level at a listening position and becomes an optimal audio signal at the listening position.

Further, in this embodiment, the controller 2 determines whether each wireless speaker 1 is to be excluded from a control target based on the input-to-output ratio of an audio signal of the wireless speaker 1, and groups the wireless speakers 1 to be selected as control targets. Then, output of an audio signal is adjusted for the grouped wireless speakers 1. Therefore, for example, it is possible to group the wireless speakers 1 installed in the same room accommodating the listener with the controller 2 and adjust output of only those wireless speakers 1.

Further, in this embodiment, the wireless speaker 1 periodically transmits a beacon signal including the ID of the wireless speaker 1. Further, the wireless speaker 1 receives a beacon signal including the ID of the wireless speaker 1 designated in the radio wave detection instruction in accordance with the radio wave detection instruction received from the controller 1, detects the received radio wave strength of the beacon signal, and notifies the controller 2 of the detected received radio wave strength.

Meanwhile, the controller 2 receives the beacon signal transmitted from the wireless speaker 1, and detects the received radio wave strength of the beacon signal. Further, the controller 2 selects the first and second wireless speakers 1 from among the grouped wireless speakers 1, transmits a radio wave detection instruction containing the ID of the second wireless speaker to the first wireless speaker 1, and acquires the received radio wave strength of the second wireless speaker detected by the first wireless speaker. Then, the controller 2 uses the received radio wave strength of a beacon signal of each of the first and second wireless speakers 1 detected by the controller 2 and the received radio wave strength of the second wireless speaker 1 detected by the first wireless speaker 1 to determine the reference coordinate system, and identifies the positions of the controller 2 and the first and second wireless speakers 1 in the reference coordinate system. Further, the controller 2 transmits a radio wave detection instruction containing the ID of the target wireless speaker 1 to each of the first and second wireless speakers 1, and acquires the received radio wave strength of the target wireless speaker 1 detected by each of the first and second wireless speakers 1. Then, the controller 2 uses the received radio wave strength of the target wireless speaker detected by each of the controller 2 and the first and second wireless speakers 1 and the positions of the controller 2 and the first and second wireless speakers 1 in the reference coordinate system to identify the position of the target wireless speaker 1 in the reference coordinate system. This processing is performed for all the grouped wireless speakers 1 other than the first and second wireless speakers 1, to thereby determine the installation states (relative positions with respect to controller 2) of the grouped wireless speakers 1 and determine the audio signal output mode of the grouped wireless speakers 1 based on the installation states. With this, it is possible to set an audio signal output mode appropriate for the grouped wireless speakers 1 depending on the installation states of those wireless speakers 1.

Further, in this embodiment, the controller 2 displays the installation states of the grouped wireless speakers 1, and receives designation of the front direction from the listener with the controller 2. Then, the controller 2 determines the audio signal output mode based on the installation states of the grouped wireless speakers 1 in which the front direction of the listener is reflected. With this, it is possible to set the audio signal output mode of the grouped wireless speakers 1 more appropriately.

[Second Embodiment]

A wireless audio system according to a second embodiment of the present invention is configured by replacing the wireless speakers 1-*a* to 1-*k* with wireless speakers 1'-*a* to 1'-*k* (hereinafter also referred to simply as "wireless speaker 1'") and replacing the controller 2 with the controller 2' in the wireless audio system according to the first embodiment illustrated in FIG. 1. The wireless speaker 1' includes a plurality of directional antennas having different directivities, and may detect a reception direction of a beacon signal based on which directional antenna has received the strongest beacon signal together with the received radio wave strength of the beacon signal. Similarly to the wireless speaker 1', the controller 2' periodically transmits a beacon signal including an ID of the controller 2'.

Figure 15:
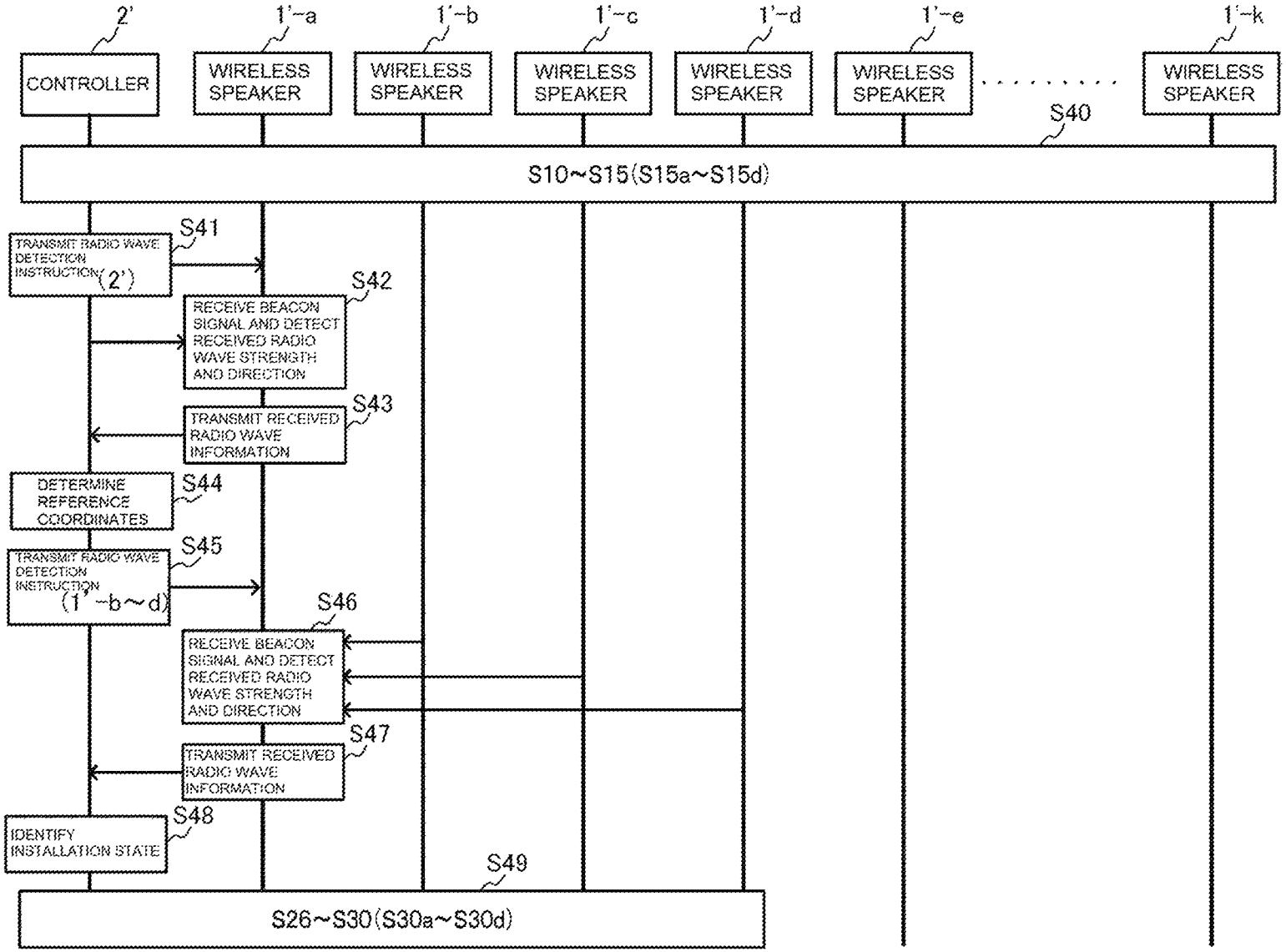
FIG. 15 is a flowchart for illustrating an operation of a wireless audio system according to a second embodiment of the present invention.

FIG. 15 is a flowchart for illustrating an operation of the wireless audio system according to this embodiment. Now, a description is given by taking an exemplary case in which a listener with the controller 2' sets the output characteristics and output mode of the wireless speakers 1'-*a* to 1'-*d* arranged in the room A.

First, Step S10 to Step S15 (Step S15*a* to Step S15*d*) illustrated in FIG. 2 and FIG. 3 are performed, and as a result, the wireless speakers 1'-*a* to 1'-*d* installed in the room A accommodating the listener with the controller 2' are grouped and the output characteristics (output timing and output level) of the grouped wireless speakers 1'-*a* to 1'-*d* are adjusted (Step S40).

Next, the controller 2' selects one wireless speaker from among the grouped wireless speakers 1'-*a* to 1'-*d*, and sets the selected wireless speaker 1' as the first wireless speaker 1'. For example, the controller 2' selects the wireless speaker 1' with the maximum received radio wave strength of a beacon signal, and sets the selected wireless speaker 1' as the first wireless speaker 1'. In this description, it is assumed that the wireless speaker 1'-*a* with the maximum received radio wave strength of a beacon signal is set as the first wireless speaker 1'. The controller 2' transmits a radio wave detection instruction containing designation of the ID of the controller 2' to the wireless speaker 1'-*a* set as the first wireless speaker 1' (Step S41).

When the first wireless speaker 1'-*a* receives the radio wave detection instruction from the controller 2', the first wireless speaker 1'-*a* receives a beacon signal including designation of the ID of the controller 2' designated in the radio wave detection instruction, and detects a received radio wave strength thereof and a reception direction thereof (Step S42). Specifically, the first wireless speaker 1'-*a* sets the maximum received radio wave strength among received radio wave strengths of a beacon signal received by the plurality of directional antennas having different directivities, as the received radio wave strength of the beacon signal, and sets a directivity range (e.g., left, center, or right) of a directional antenna having received the maximum received radio wave strength as a reception direction of the beacon signal. Then, the first wireless speaker 1'-*a* transmits received radio wave information including the detected received radio wave strength and reception direction to the controller 2' (Step S43).

When the controller 2' receives the received radio wave information from the first wireless speaker 1'-*a*, the controller 2' uses the received radio wave strength and reception direction (received radio wave strength and reception direction of beacon signal of controller 2' detected by first wireless speaker 1'-*a*) included in the received radio wave information to determine a reference coordinate system for identifying installation positions of the grouped wireless speakers 1'-*a* to 1'-*d* (Step S44).

Figure 16:
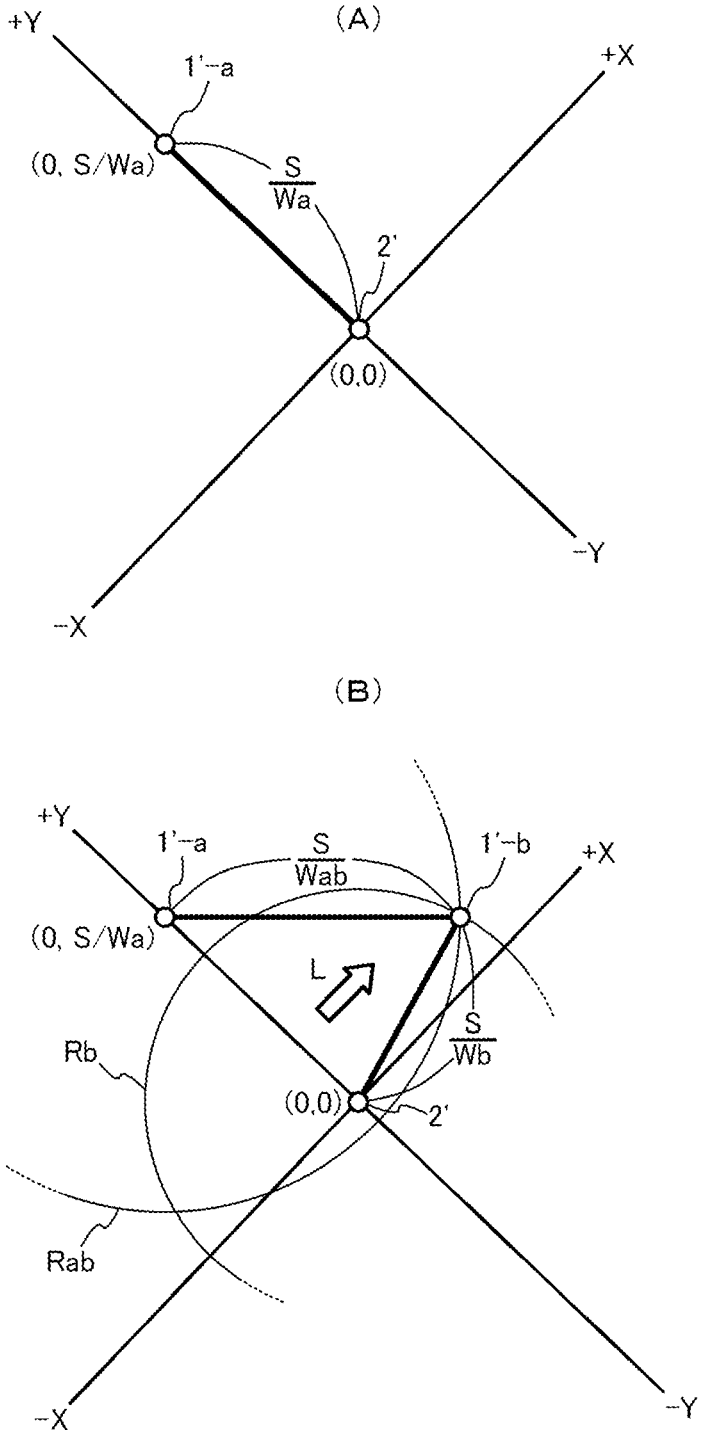
FIG. 16(A) is a diagram for illustrating a method of determining a reference coordinate system for identifying an installation position of a wireless speaker 1'.
FIG. 16(B) is a diagram for illustrating a method of identifying positions of the grouped wireless speakers 1' other than a first wireless speaker.

FIG. 16(A) is a diagram for illustrating a method of determining the reference coordinate system for identifying the installation position of the wireless speaker 1'.

As illustrated in FIG. 16(A), the controller 2' sets, as a reference strength S, a received radio wave strength Wa of a beacon signal of the first wireless speaker 1'-*a* detected by the controller 2' or a beacon signal of the controller 2' detected by the first wireless speaker 1'-*a*. Next, the controller 2' divides the reference strength S by the received radio wave strength Wa of a beacon signal of the first wireless speaker 1'-*a* detected by the controller 2' or a beacon signal of the controller 2' detected by the first wireless speaker 1'-*a*, and sets its result S/Wa as a distance between the controller 2' and the wireless speaker 1'-*a*.

Next, the controller 2' sets the position of the controller 2' as an origin (0, 0), and sets a given point on a circle of a radius of S/Wa about the origin as the position of the first wireless speaker 1'-*a*. Then, the controller 2' sets the side of the first wireless speaker 1'-*a* as a positive side and sets a straight line passing through the controller 2' and the first wireless speaker 1'-*a* as a Y-axis, to thereby determine a reference coordinate system (XY-orthogonal coordinate system). Then, the controller 2' converts the position of the first wireless speaker 1'-*a* into a position (0, S/Wa) in the reference coordinate system. Further, the controller 2' sets the reception direction of a beacon signal of the controller 2' detected by the first wireless speaker 1'-*a* as a direction (−Y direction) in which the first wireless speaker 1'-*a* faces the controller 2'.

Next, when the controller 2 determines the reference coordinate system as described above, the controller 2 transmits, to the wireless speaker 1'-*a* set as the first wireless speaker, a radio wave detection instruction containing designation of IDs of the grouped wireless speakers 1'-*b* to 1'-*d* other than the first wireless speaker 1'-*a* (Step S45).

When the first wireless speaker 1'-*a* receives the radio wave detection instruction from the controller 2', the first wireless speaker 1'-*a* receives a beacon signal including the ID of the wireless speaker 1'-*b* designated in the radio wave detection instruction, a beacon signal including the ID of the wireless speaker 1'-*c*, and a beacon signal including the ID of the wireless speaker 1'-*d* to detect received radio wave strengths and reception directions thereof (Step S46). Then, the first wireless speaker 1'-*a* transmits received radio wave information including the received radio wave strengths and reception directions of beacon signals of the respective wireless speakers 1'-*c* and 1'-*d* to the controller 2' (Step S47).

When the controller 2' receives the received radio wave information from the first wireless speaker 1'-*a*, the controller 2' identifies the positions of the grouped wireless speakers 1'-*b* to 1'-*d* in the reference coordinate system based on the received radio wave strengths and reception directions of beacon signals (received radio wave strengths and reception directions of beacon signals of wireless speakers 1'-*b* to 1'-*d* detected by first wireless speaker 1'-*a*) included in the received radio wave information received from the first wireless speaker 1'-*a*, the received radio wave strengths of beacon signals of the wireless speakers 1'-*b* to 1'-*d* detected by the controller 2', the positions of the controller 2' and the first wireless speaker 1'-*a* in the reference coordinate system, and the reception direction of a beacon signal of the controller 2' detected by the first wireless speaker 1'-*a*. With this, the installation states of all the grouped wireless speakers 1'-*a* to 1'-*d* are identified (Step S48).

Figure 17:
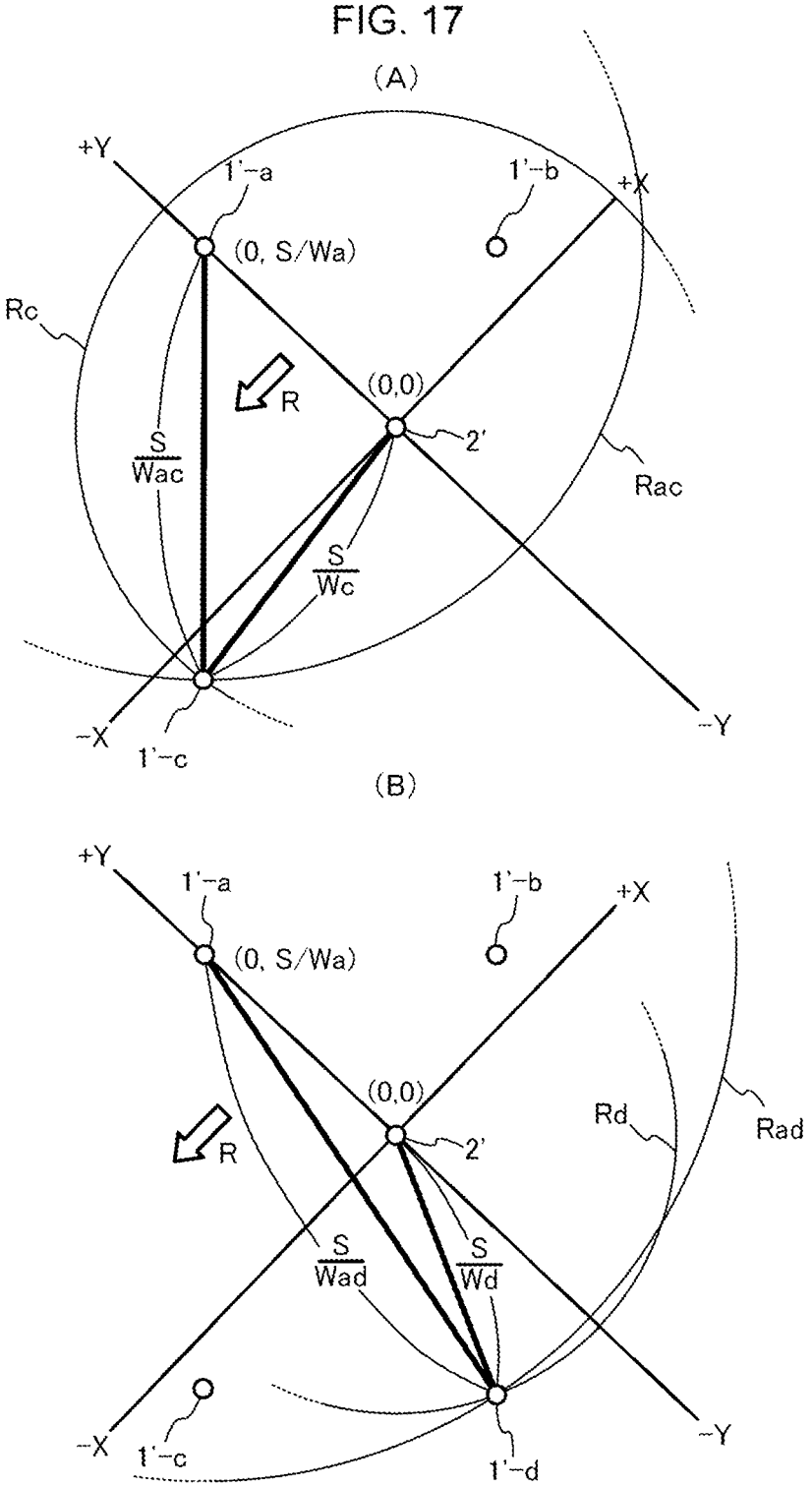
FIG. 17(A) and FIG. 17(B) are diagrams for illustrating a method of identifying the positions of the grouped wireless speakers 1' other than the first wireless speaker.

FIG. 16(B), FIG. 17(A), and FIG. 17(B) are diagrams for illustrating a method of identifying the positions of the grouped wireless speakers 1' other than the first wireless speaker 1'-*a*.

First, as illustrated in FIG. 16(B), the controller 2' divides the reference strength S used at the time of determining the reference coordinate system by the received radio wave strength Wb of a beacon signal of the wireless speaker 1'-*b* detected by the controller 2', and sets its result S/Wb as a distance between the controller 2' and the wireless speaker 1'-*b*. Then, the controller 2' acquires a circle Rb centered at the controller 2' with a radius of S/Wb. Further, the controller 2' divides the reference strength S by the received radio wave strength Wab of a beacon signal of the wireless speaker 1'-*b* detected by the first wireless speaker 1'-*a*, and sets its result S/Wab as a distance between the first wireless speaker 1'-*a* and the wireless speaker 1'-*b*. Then, the controller 2' acquires a circle Rab centered at the first wireless speaker 1'-*a* with a radius of S/Wab. Next, the controller 2' compares the reception direction of a beacon signal of the wireless speaker 1'-*b* detected by the first wireless speaker 1'-*a* with the reception direction of a beacon signal of the controller 2' detected by the first wireless speaker 1'-*a*, to determine on which of left and right sides of the controller 2' the wireless speaker 1'-*b* is located as viewed from the first wireless speaker 1'-*a*. In this description, it is assumed that the wireless speaker 1'-*b* is determined as being located on the left side. Then, the controller 2' acquires one of two intersections between the circle Rb and the circle Rab that is located on the left side of the controller 2' as viewed from the first wireless speaker 1'-*a*, and sets the intersection as the position of the wireless speaker 1'-*b* in the reference coordinate system.

Next, as illustrated in FIG. 17(A), the controller 2' divides the reference strength S used at the time of determining the reference coordinate system by the received radio wave strength We of a beacon signal of the wireless speaker 1'-*c* detected by the controller 2', and sets its result S/Wc as a distance between the controller 2' and the wireless speaker 1'-*c*. Then, the controller 2' acquires a circle Rc centered at the controller 2' with a radius of S/Wc. Further, the controller 2' divides the reference strength S by the received radio wave strength Wac of a beacon signal of the wireless speaker 1'-*b* detected by the first wireless speaker 1'-*a*, and sets its result S/Wac as a distance between the first wireless speaker 1'-*a* and the wireless speaker 1'-*c*. Then, the controller 2' acquires a circle Rac centered at the first wireless speaker 1'-*a* with a radius of S/Wac. Next, the controller 2' compares the reception direction of a beacon signal of the wireless speaker 1'-*c* detected by the first wireless speaker 1'-*a* with the reception direction of a beacon signal of the controller 2' detected by the first wireless speaker 1'-*a*, to determine on which of left and right sides of the controller 2' the wireless speaker 1'-*c* is located as viewed from the first wireless speaker 1'-*a*. In this description, it is assumed that the wireless speaker 1'-*c* is determined as being located on the right side. Then, the controller 2' acquires one of two intersections between the circle Rc and the circle Rac that is located on the right side of the controller 2' as viewed from the first wireless speaker 1'-*a*, and sets the intersection as the position of the wireless speaker 1'-*c* in the reference coordinate system.

Next, as illustrated in FIG. 17(B), the controller 2' divides the reference strength S used at the time of determining the reference coordinate system by the received radio wave strength Wd of a beacon signal of the wireless speaker 1'-*d* detected by the controller 2', and sets its result S/Wd as a distance between the controller 2' and the wireless speaker 1'-*d*. Then, the controller 2' acquires a circle Rd centered at the controller 2' with a radius of S/Wd. Further, the controller 2' divides the reference strength S by the received radio wave strength Wad of a beacon signal of the wireless speaker 1'-*d* detected by the first wireless speaker 1'-*a*, and sets its result S/Wad as a distance between the first wireless speaker 1'-*a* and the wireless speaker 1'-*d*. Then, the controller 2' acquires a circle Rad centered at the first wireless speaker 1'-*a* with a radius of S/Wad. Next, the controller 2' compares the reception direction of a beacon signal of the wireless speaker 1'-*d* detected by the first wireless speaker 1'-*a* with the reception direction of a beacon signal of the controller 2' detected by the first wireless speaker 1'-*a*, to determine on which of left and right sides of the controller 2' the wireless speaker 1'-*d* is located as viewed from the first wireless speaker 1'-*a*. In this description, it is assumed that the wireless speaker 1'-d is determined as being located on the right side. Then, the controller 2' acquires one of two intersections between the circle Rd and the circle Rad that is located on the right side of the controller 2' as viewed from the first wireless speaker 1'-*a*, and sets the intersection as the position of the wireless speaker 1'-*d* in the reference coordinate system.

Then, Step S26 to Step S30 (Step S30*a* to Step S30*d*) illustrated in FIG. 4 are performed, and as a result, the audio signal output mode of the wireless speakers 1'-*a* to 1'-*d* installed in the room A accommodating the listener with the controller 2' and the assigned channels of those respective wireless speakers 1'-*a* to 1'-*d* are set (Step S49).

Next, details of the wireless speaker 1' and the audio controller 2' of the wireless audio system according to this embodiment are described.

First, the wireless speaker 1' is described.

Figure 18:
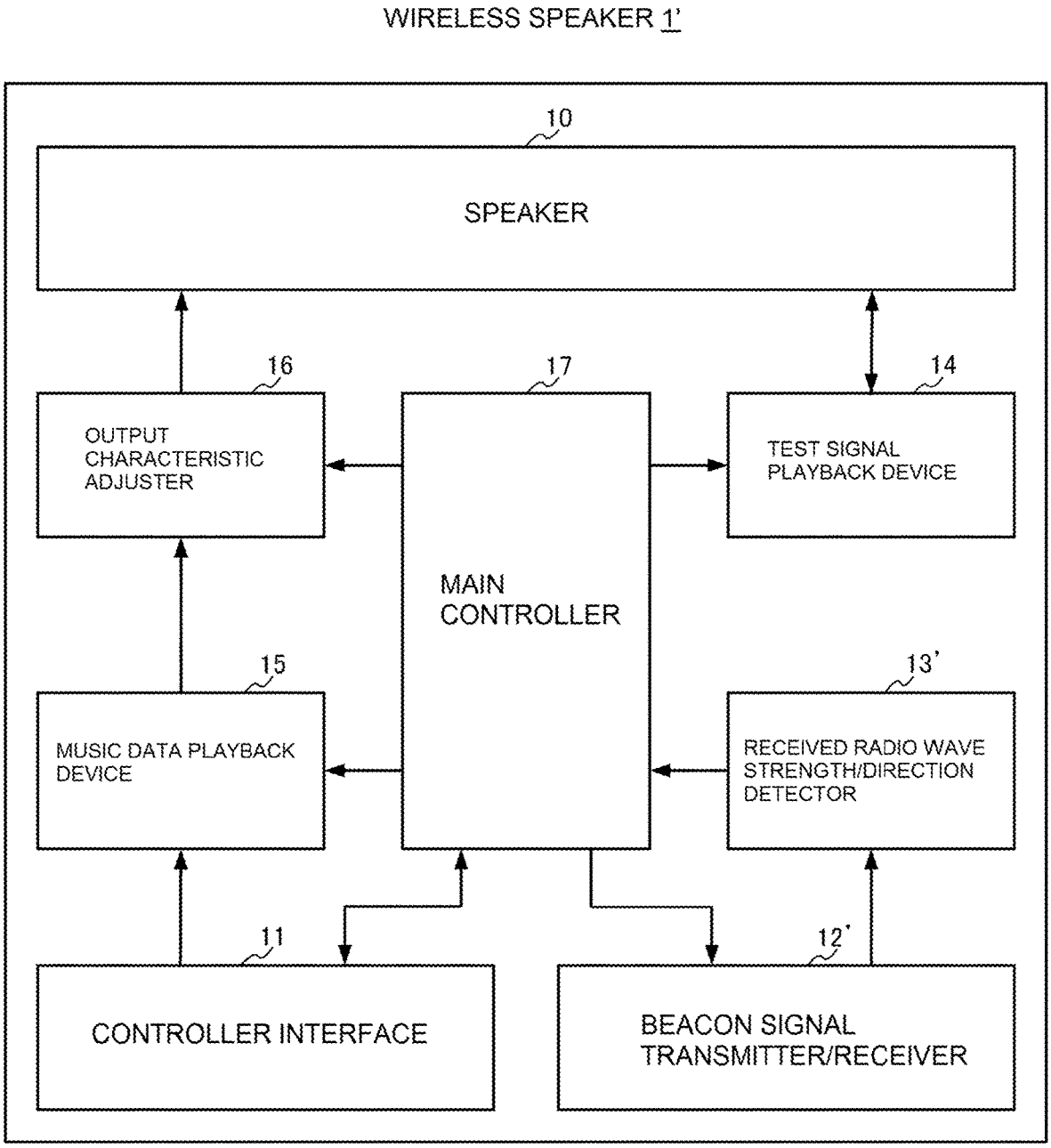
FIG. 18 is a schematic functional configuration diagram of the wireless speaker 1'.

FIG. 18 is a schematic functional configuration diagram of the wireless speaker 1'. A functional configuration of the wireless speaker 1' illustrated in FIG. 18 is, for example, implemented in the following manner: in a computer including a CPU, a memory, an auxiliary storage device, for example, a flash memory, a wireless communication device based on, for example, Bluetooth (trademark), and a speaker, the CPU loads a predetermined program onto the memory from the auxiliary storage device to execute the program.

The wireless speaker 1' according to this embodiment is different from the wireless speaker 1 according to the first embodiment illustrated in FIG. 8 in that the beacon signal transmitter/receiver 12 is replaced with a beacon signal transmitter/receiver 12' and the received radio wave strength detector 13 is replaced with a received radio wave strength/direction detector 13'. Other components are similar to those of the wireless speaker 1 according to the first embodiment illustrated in FIG. 8.

The beacon signal transmitter/receiver 12' includes a plurality of directional antennas having different directivities, and those directional antennas are used to transmit a beacon signal including an ID, for example, an RSSI, assigned to the wireless speaker 1'. Further, the beacon signal transmitter/receiver 12' receives a beacon signal including the ID notified by the main controller 17 in accordance with an instruction from the main controller 17.

The received radio wave strength/direction detector 13' identifies a directional antenna having received the strongest beacon signal among the plurality of directional antennas included in the beacon signal transmitter/receiver 12'. Then, the received radio wave strength/direction detector 13' detects the received radio wave strength of the beacon signal received by the identified directional antenna, and detects a directivity range (e.g., left, center, or right) of the directional antenna as the reception direction of the beacon signal.

An operation of the wireless speaker 1' according to this embodiment is basically the same as the operation of the wireless speaker 1 according to the first embodiment illustrated in FIG. 9. However, processing of Step S207 to Step S209 is different. Specifically, in Step S207, the beacon signal transmitter/receiver 12' uses the plurality of directional antennas having different directivities to receive a beacon signal including the ID notified by the main controller 17. In Step S208, the received radio wave strength/direction detector 13' identifies a directional antenna having received the strongest beacon signal among the plurality of directional antennas included in the beacon signal transmitter/receiver 12', detects the received radio wave strength of the beacon signal received by the identified directional antenna, and detects a directivity range of the directional antenna as the reception direction of the beacon signal. Then, in Step S209, the main controller 17 generates received radio wave information including the received radio wave strength and reception direction detected by the received radio wave strength/direction detector 13' and the ID notified to the beacon signal transmitter/receiver 12', and transmits the received radio wave information to the controller 2' via the controller interface 11.

Next, the audio controller 2' is described.

Figure 19:
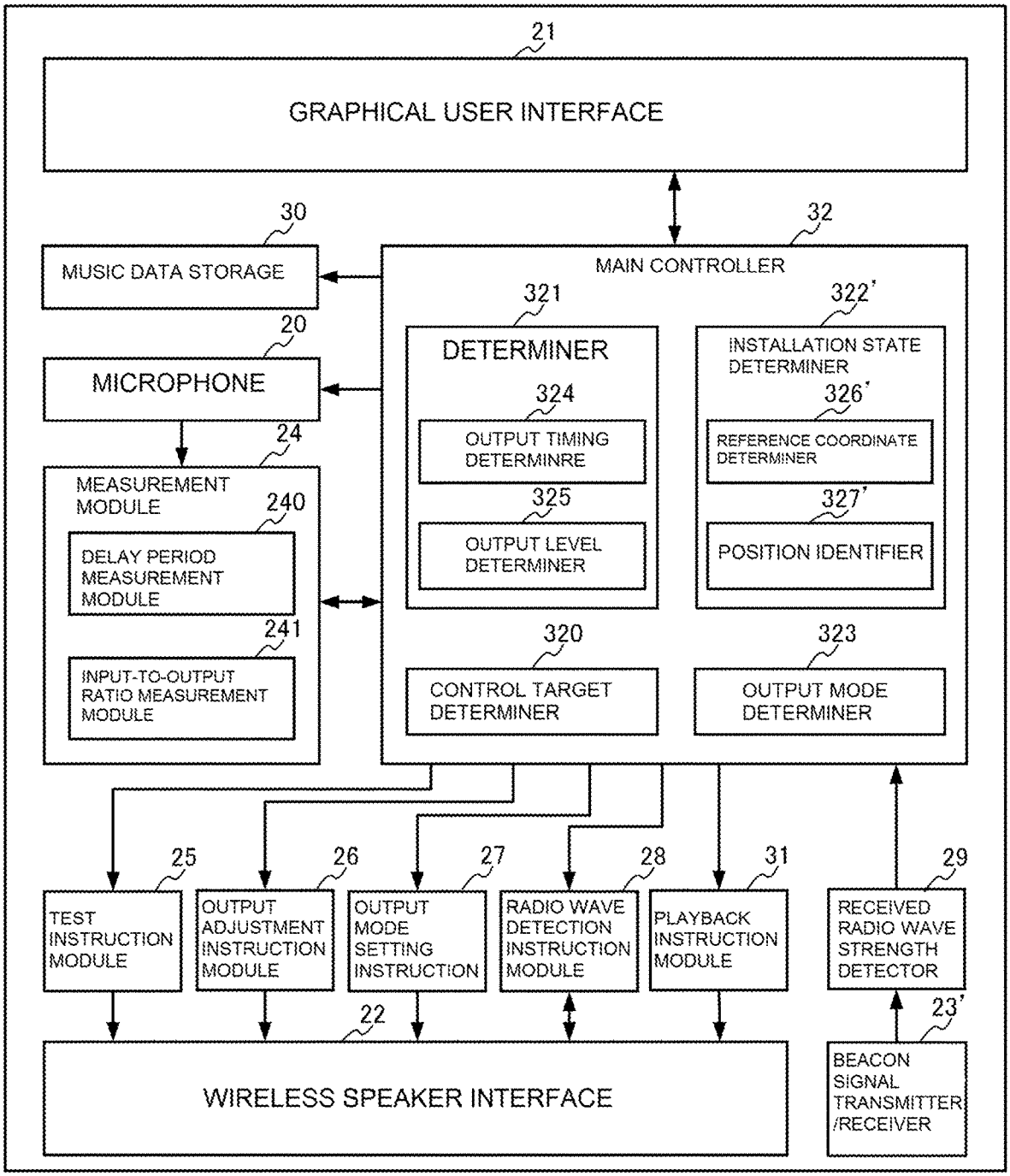
FIG. 19 is a schematic functional configuration diagram of a controller 2'.

FIG. 19 is a schematic functional configuration diagram of the audio controller 2'. The functional configuration of the audio controller 2' illustrated in FIG. 19 is, for example, implemented in the following manner: in a portable computer, for example, a smartphone or a tablet PC, which includes a CPU, a memory, an auxiliary storage device, for example, a flash memory, an input/output device, for example, a touch panel, a display, or a pointing device, a wireless communication device based on, for example, Bluetooth (trademark), and a microphone, the CPU loads a predetermined program onto the memory from the auxiliary storage device to execute the program.

The controller 2' according to this embodiment is different from the controller 2 according to the first embodiment illustrated in FIG. 10 in that the beacon signal receiver 23 is replaced with a beacon signal transmitter/receiver 23' and the installation state determiner 322 is replaced with an installation state determiner 322'. Other components are similar to those of the controller 2 according to the first embodiment illustrated in FIG. 10.

The beacon signal transmitter/receiver 23' is configured to periodically transmit a beacon signal including an ID, for example, an RSSI, assigned to the controller 2 in a wireless manner. Further, the beacon signal transmitter/receiver 23' is configured to receive in a wireless manner a beacon signal periodically transmitted from the wireless speaker 1.

The installation state determiner 322' is configured to determine the installation states of the wireless speakers 1' grouped by the control target determiner 320, and includes a reference coordinate determiner 326' and a position identifier 327'.

The reference coordinate determiner 326' identifies relative positions of the controller 2' and the first wireless speaker 1' based on the received radio wave strength of a beacon signal detected by the received radio wave strength detector 29 for the first wireless speaker 1' selected from among the grouped wireless speakers 1' or the received radio wave strength of a beacon signal of the controller 2' detected by the first wireless speaker 1' and the reception direction of the beacon signal of the controller 2' detected by the first wireless speaker 1'. Then, the reference coordinate determiner 326' determines the reference coordinate system based on the identified relative positions (refer to FIG. 16(A)).

The position identifier 327' identifies positional information on each of the wireless speakers 1' other than the first wireless speaker 1' in the reference coordinate system based on the received radio wave strengths of beacon signals detected by the received radio wave strength detector 29 for the wireless speakers 1' other than the first wireless speaker 1' among the grouped wireless speakers 1', the received radio wave strength and reception direction of a beacon signal of each of the other wireless speakers 1' in the group detected by the first wireless speaker 1', the positional information on the controller 2' and the first wireless speaker 1' in the reference coordinate system, and the reception direction of a beacon signal of the controller 2' detected by the first wireless speaker 1' (refer to FIG. 16(B), FIG. 17(A), and FIG. 17(B)).

An operation of the controller 2' according to this embodiment is different from the operation of the controller 2 according to the first embodiment illustrated in FIG. 11 in that output mode setting processing (Step S223') is executed in place of the output mode setting processing (Step S223). Other processing is the same as the operation of the controller 2 according to the first embodiment illustrated in FIG. 11.

Figure 20:
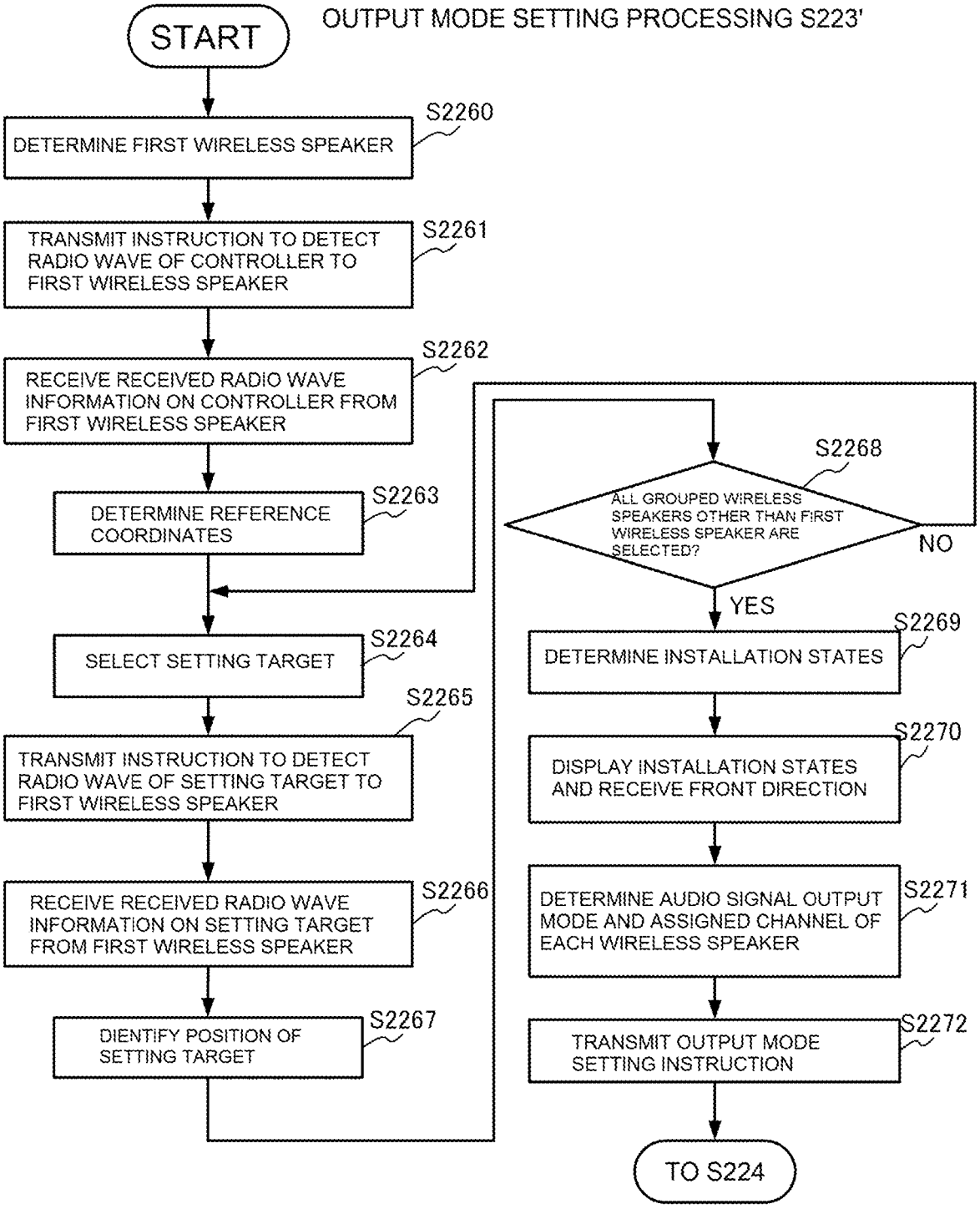
FIG. 20 is a flowchart for illustrating output mode setting processing (Step S223') of the controller 2'.

FIG. 20 is a flowchart for illustrating the output mode setting processing (Step S223') of the controller 2 illustrated in FIG. 11.

First, the reference coordinate determiner 326' of the installation state determiner 322' of the main controller 32 determines the first wireless speaker 1' based on the received radio wave strengths of beacon signals detected by the received radio wave strength detector 29 for each of the wireless speakers 1 grouped by the control target determiner 320 (Step S2260). For example, the reference coordinate determiner 326' sets the wireless speaker 1' of the strongest received radio wave strength as the first wireless speaker 1'.

Next, the reference coordinate determiner 326' notifies the radio wave detection instruction module 28 of the ID of the first wireless speaker 1' as the ID of a detector and the ID of the controller 2' as the ID of a detection target. In response to this, the radio wave detection instruction module 28 transmits, from the wireless speaker interface 22, a radio wave detection instruction containing the ID of the first wireless speaker 1' as the ID of a detector and the ID of the controller 2' as the ID of a detection target (Step S2261). Then, the radio wave detection instruction module 28 receives, from the first wireless speaker 1', the received radio wave information including the received radio wave strength and reception direction of the controller 2' detected by the first wireless speaker 1' (Step S2262).

Next, the reference coordinate determiner 326' determines the reference coordinate system in the manner described with reference to FIG. 16(A) based on the received radio wave strength of a beacon signal of the first wireless speaker detected by the received radio wave strength detector 29 or the received radio wave strength of a beacon signal of the controller 2' detected by the first wireless speaker, which is included in the received radio wave information received from the first wireless speaker, and the reception direction of the beacon signal of the controller 2' detected by the first wireless speaker, which is included in the received radio wave information received from the first wireless speaker, and identifies the positions of the controller 2' and the first wireless speaker in the reference coordinate system (Step S2263).

Next, the position identifier 327' of the installation state determiner 322' selects, as a setting target, the unselected wireless speaker 1' other than the first wireless speaker 1' from the grouped wireless speakers 1' (Step S2264).

Next, the position identifier 327' notifies the radio wave detection instruction module 28 of the IDs of the first wireless speaker 1' as the ID of a detector and the ID of the wireless speaker 1' selected as a setting target as the ID of a detection target. In response to this, the radio wave detection instruction module 28 transmits, from the wireless speaker interface 22, a radio wave detection instruction containing the ID of the first wireless speaker 1' as the ID of a detector and the ID of the wireless speaker 1' selected as a setting target as the ID of a detection target (Step S2265). Then, the radio wave detection instruction module 28 receives, from the first wireless speaker 1', the received radio wave information including the received radio wave strength and reception direction of a beacon signal of the wireless speaker 1' selected as a setting target, which is detected by the first wireless speaker 1' (Step S2266).

Next, the position identifier 327' identifies the position of the wireless speaker 1' selected as a setting target in the reference coordinate system in the manner described with reference to FIG. 16(B), FIG. 17(A), and FIG. 17(B) based on the received radio wave strength of a beacon signal of the wireless speaker 1' selected as a setting target, which is detected by the received radio wave strength detector 29, the received radio wave strength and reception direction (received radio wave strength and reception direction of beacon signal of wireless speaker 1' selected as setting target, which is detected by first wireless speaker 1') included in the received radio wave information received from the first wireless speaker 1', the positions of the controller 2' and the first wireless speaker 1' in the reference coordinate system, and the reception direction of a beacon signal of the controller 2' detected by the first wireless speaker 1' (Step S2267).

Next, when there is a wireless speaker 1' unselected as a setting target other than the first wireless speaker 1' among the grouped wireless speakers 1' (NO in Step S2268), the position identifier 327' returns to Step S2264. On the contrary, when all the grouped wireless speakers 1' other than the first wireless speaker 1' are already selected as setting targets (YES in Step S2268), it means that the positions of all the grouped wireless speakers 1' including the first wireless speaker 1' in the reference coordinate system have been identified. The installation state determiner 322' determines the installation states (relative position of each of grouped wireless speakers 1' with respect to controller 2') of the grouped wireless speakers 1' based on the position of the controller 2' in the reference coordinate system and the positions of all the grouped wireless speakers 1' in the reference coordinate system (Step S2269). Then, the installation state determiner 322' passes the determined installation states to the output mode determiner 323.

The output mode determiner 323 displays the installation states of the grouped wireless speakers 1', which are received from the installation state determiner 322', on the graphical user interface 21 (refer to FIG. 7), and receives designation of a front direction of the user (controller 2') from the user with the controller 2' (Step S2270).

Next, the output mode determiner 323 reflects the front direction received from the user in the installation states of the grouped wireless speakers 1'. With this, the output mode determiner 323 identifies in which of front, rear, left, and right directions of the user (controller 2') each of the grouped wireless speakers 1' is installed.

Next, the output mode determiner 323 determines the audio signal output mode of the grouped wireless speakers 1' and the assigned channels of those respective wireless speakers 1' based on the number of grouped wireless speakers 1' and the installation states in which the front direction of the user is reflected (Step S2271). Then, the output mode determiner 323 notifies the output mode setting instruction module 27 of the audio signal output mode of the grouped wireless speakers 1' and the assigned channels of those respective wireless speakers 1' together with the IDs of those respective wireless speakers 1'.

In response to this, the output mode setting instruction module 27 transmits, from the wireless speaker interface 22, an output mode setting instruction containing the audio signal output mode notified by the output mode determiner 323 and the assigned channel associated with the ID for each of the grouped wireless speakers 1' and having each of the grouped wireless speakers 1' as its destination (Step S2272). After that, the processing proceeds to Step S224 of FIG. 11.

In the above, the second embodiment of the present invention has been described.

This embodiment has the following effect in addition to the above-mentioned effect of the first embodiment. Specifically, the controller 2' transmits a radio wave detection instruction to only the first wireless speaker 1' and receives received radio wave information. Thus, it is possible to reduce communication traffic compared to the first embodiment in which the controller 2 transmits a radio wave detection instruction to each of the first and second wireless speakers 1 and receives received radio wave information. As a result, it is possible to determine the installation states of the grouped wireless speakers 1' more quickly.

The present invention is not limited to each of the embodiments described above, and various modifications may be made thereto within the scope of the gist of the present invention.

For example, in each of the above-mentioned embodiments, the controllers 2 and 2' transmit a test instruction containing designation of the output time and output level to the wireless speakers 1 and 1', respectively, and in response to this, the wireless speakers 1 and 1' playback a test signal at the output level designated in the test instruction at the output time designated in the test instruction. However, the present invention is not limited to this configuration. The test instruction to be transmitted from the controllers 2 and 2' may not include designation of the output time and output level. In this case, the wireless speakers 1 and 1' notify the controllers 2 and 2' of the output time and output level of the test signal, respectively. Further, the output level may be set to a level defined in advance by the controllers 2 and 2' and the wireless speakers 1 and 1' to omit communication therebetween.

Further, in each of the above-mentioned embodiments, transmission of various instructions from the controllers 2 and 2' to the wireless speakers 1 and 1' maybe multicast transmission. In other cases, when the controllers 2 and 2' recognize addresses of the respective wireless speakers 1 and 1', the transmission may be unicast transmission.

Further, in each of the above-mentioned embodiments, the controllers 2 and 2' and the wireless speakers 1 and 1' are directly connected to each other via a wireless network using near-field communication, for example, wireless LAN ad-hoc mode communication or Bluetooth (trademark). However, the controllers 2 and 2' and the wireless speakers 1 and 1' may be connected to each other via an access point.

Further, in the configuration of this embodiment, after the wireless speakers 1 installed in the same room are grouped, the output level of an audio signal of each of those wireless speakers 1 is set based on the input-to-output ratio of a test signal received from each of those grouped wireless speakers 1. However, the present invention is not limited to this configuration. For example, after the installation positions of the respective grouped wireless speakers 1 are identified, the wireless speaker 1 installed in front of the user is identified by the designation 201 of the front direction P given by the user, and the input-to-output ratio of an audio signal received from the wireless speaker 1 installed in front of the user is set as the reference ratio. Then, the output level of each of the grouped wireless speakers 1 may be adjusted so that an audio signal output from each of those grouped wireless speakers 1 exhibits the same level at the listening position as that of an audio signal output from the wireless speaker 1 installed in front of the user. The user is generally considered to install the wireless speaker 1, which is the most important among the plurality of wireless speakers 1 installed in the same room, in front. Thus, this configuration is more useful and effective for the user who desires to adjust the sound volume level of another wireless speaker with respect to the sound volume level of the most important wireless speaker 1.

Further, in the configuration of this embodiment, the music data storage 30 of the controller 2 stores music data. However, the present invention is not limited to this configuration. For example, a media server connected via the Internet may store music data, each wireless speaker 1 may acquire the music data stored in the media server via wireless communication such as Bluetooth (trademark) or Wi-Fi (trademark) in response to an instruction from the controller 2, and the wireless speaker 1 may play back and output the acquired audio signal. In this case, the output timing of an audio signal may be adjusted based on a synchronization signal transmitted from the controller 2.

REFERENCE SIGNS LIST

1, 1', 1-*a* to 1-*k*, 1'-*a* to 1'-*k*: wireless speaker, 2, 2': controller, 10: speaker, 11: controller interface, 12, 12': beacon signal transmitter/receiver, 13: received radio wave strength detector, 13': received radio wave strength/direction detector, 14: test signal playback device, 15: music data playback device, 16: output characteristic adjuster, 17: main controller, 20: microphone, 21: graphical user interface, 22: wireless speaker interface, 23: beacon signal receiver, 23': beacon signal transmitter/receiver, 24: measurement module, 25: test instruction module, 26: output adjustment instruction module, 27: output mode setting instruction module, 28: radio wave detection instruction module, 29: received radio wave strength detector, 30: music data storage, 31: playback instruction module, 32: main controller, 240: delay period measurement module, 241: input-to-output ratio measurement module, 320: control target determiner, 321: determiner, 322, 322': installation state determiner, 323: output mode determiner, 324: output timing determiner, 325: output level determiner, 326, 326': reference coordinate determiner, 327, 327': position identifier

The invention claimed is:

1. A wireless audio system, comprising a plurality of wireless speakers and a controller configured to remotely operate the plurality of wireless speakers, wherein the plurality of wireless speakers each include:

test signal output means for outputting a test signal, which is a predetermined audio signal, to notify the controller of an output time of the test signal, or for outputting the test signal at an output time designated in a test instruction, which is received from the controller, in accordance with the test instruction; and output adjustment means for adjusting an output timing of an audio signal to be played back in accordance with an output adjustment instruction received from the controller, and wherein the controller includes:

a microphone configured to collect a sound of the test signal;

measurement means for measuring a delay period, the delay period being a difference between the output time of the test signal received from each of the plurality of wireless speakers or the output time of the test signal designated in the test instruction and an input time of the test signal into the microphone, in which the controller transmits the test instruction to each of the plurality of wireless speakers to cause the each of the plurality of wireless speakers to output the test signal, and to cause the microphone to collect the sound of the test signal, and;

determination means for determining an output timing of each of the plurality of wireless speakers based on the delay period of the each of the plurality of wireless speakers measured by the measurement means; and output adjustment instruction transmission means for transmitting, to each of the plurality of wireless speakers, the output adjustment instruction containing designation of the output timing of the each of the plurality of wireless speakers determined by the determination means, wherein the test signal output means of each of the plurality of wireless speakers is configured to notify the controller of an output level of the test signal, or to output the test signal at an output level designated in the test instruction received from the controller, wherein the output adjustment means of each of the plurality of wireless speakers is configured to adjust an output level of the audio signal to be played back in accordance with the output adjustment instruction received from the controller, wherein the measurement means of the controller is configured to measure, for each of the plurality of wireless speakers, an input-to-output ratio, which is a ratio of an input level of the test signal into the microphone to the output level of the test signal received from the each of the plurality of wireless speakers or the output level of the test signal designated in the test instruction, wherein the determination means of the controller is configured to determine the output level of each of the plurality of wireless speakers based on the input-to-output ratio of the each of the plurality of wireless speakers measured by the measurement means, and wherein the output adjustment instruction transmission means of the controller is configured to transmit, to each of the plurality of wireless speakers, designation of the output level of the each of the plurality of wireless speakers determined by the determination means by containing the designation in the output adjustment instruction, wherein the controller further includes control target determination means for determining a wireless speaker to be excluded from a control target among the plurality of wireless speakers based on the input-to-output ratio of each of the plurality of wireless speakers measured by the measurement means, and wherein the output adjustment instruction transmission means of the controller is configured to avoid transmitting the output adjustment instruction to the wireless speaker determined to be excluded from the control target by the control target determination means.

2. A wireless audio system, comprising a plurality of wireless speakers and a controller configured to remotely operate the plurality of wireless speakers, wherein the plurality of wireless speakers each include:

test signal output means for outputting a test signal, which is a predetermined audio signal, to notify the controller of an output time of the test signal, or for outputting the test signal at an output time designated in a test instruction, which is received from the controller, in accordance with the test instruction; and output adjustment means for adjusting an output timing of an audio signal to be played back in accordance with an output adjustment instruction received from the controller, and wherein the controller includes:

a microphone configured to collect a sound of the test signal;

measurement means for measuring a delay period, the delay period being a difference between the output time of the test signal received from each of the plurality of wireless speakers or the output time of the test signal designated in the test instruction and an input time of the test signal into the microphone, in which the controller transmits the test instruction to each of the plurality of wireless speakers to cause the each of the plurality of wireless speakers to output the test signal, and to cause the microphone to collect the sound of the test signal, and;

determination means for determining an output timing of each of the plurality of wireless speakers based on the delay period of the each of the plurality of wireless speakers measured by the measurement means; and output adjustment instruction transmission means for transmitting, to each of the plurality of wireless speakers, the output adjustment instruction containing designation of the output timing of the each of the plurality of wireless speakers determined by the determination means, wherein the plurality of wireless speakers each further include:

beacon signal transmission means for transmitting a beacon signal including identification information on an own wireless speaker; and received radio wave information notification means for receiving the beacon signal including identification information designated in a radio wave detection instruction received from the controller, detecting a received radio wave strength of the beacon signal, and notifying the controller of the detected received radio wave strength, in accordance with the radio wave detection instruction, and wherein the controller further includes:

received radio wave strength detection means for receiving a beacon signal transmitted from each of the plurality of wireless speakers and detecting a received radio wave strength of the beacon signal;

reference coordinate identification means for transmitting, to a first wireless speaker for which a received radio wave strength is detected by the received radio wave strength detection means among the plurality of wireless speakers, a radio wave detection instruction containing designation of identification information on a second wireless speaker for which a received radio wave strength is detected by the received radio wave strength detection means, acquiring a received radio wave strength of the second wireless speaker detected by the first wireless speaker from the first wireless speaker, and identifying a reference coordinate system identified by relative positions of the controller, the first wireless speaker, and the second wireless speaker based on the received radio wave strength of each of the first and second wireless speakers detected by the received radio wave strength detection means and the received radio wave strength of the second wireless speaker detected by the first wireless speaker;

position identification means for performing, for each of the plurality of wireless speakers excluding the first and second wireless speakers, processing of: transmitting, to each of the first and second wireless speakers, a radio wave detection instruction containing designation of identification information on a wireless speaker being a measurement target for which a received radio wave strength is detected by the received radio wave strength detection means; acquiring received radio wave strengths of the wireless speaker being the measurement target detected by the first and second wireless speakers from the first and second wireless speakers; and identifying a position of the wireless speaker being the measurement target based on the received radio wave strength of the wireless speaker being the measurement target detected by the received radio wave strength detection means, the received radio wave strengths of the wireless speaker being the measurement target detected by the first and second wireless speakers, and the reference coordinate system identified by the reference coordinate identification means;

installation state determination means for determining installation states of the plurality of wireless speakers with respect to the controller based on the reference coordinate system identified by the reference coordinate identification means and positions of the plurality of wireless speakers excluding the first and second wireless speakers identified by the position identification means; and output mode determination means for determining an audio signal output mode of audio signals to be output from the plurality of wireless speakers based on the installation states determined by the installation state determination means.

3. A wireless audio system, comprising a plurality of wireless speakers and a controller configured to remotely operate the plurality of wireless speakers, wherein the plurality of wireless speakers each include:

test signal output means for outputting a test signal, which is a predetermined audio signal, to notify the controller of an output time of the test signal, or for outputting the test signal at an output time designated in a test instruction, which is received from the controller, in accordance with the test instruction; and output adjustment means for adjusting an output timing of an audio signal to be played back in accordance with an output adjustment instruction received from the controller, and wherein the controller includes:

a microphone configured to collect a sound of the test signal;

measurement means for measuring a delay period, the delay period being a difference between the output time of the test signal received from each of the plurality of wireless speakers or the output time of the test signal designated in the test instruction and an input time of the test signal into the microphone, in which the controller transmits the test instruction to each of the plurality of wireless speakers to cause the each of the plurality of wireless speakers to output the test signal, and to cause the microphone to collect the sound of the test signal, and;

determination means for determining an output timing of each of the plurality of wireless speakers based on the delay period of the each of the plurality of wireless speakers measured by the measurement means; and output adjustment instruction transmission means for transmitting, to each of the plurality of wireless speakers, the output adjustment instruction containing designation of the output timing of the each of the plurality of wireless speakers determined by the determination means, wherein the plurality of wireless speakers each further include:

beacon signal transmission means for transmitting a beacon signal including identification information on an own wireless speaker; and received radio wave information notification means for receiving the beacon signal including identification information designated in a radio wave detection instruction received from the controller, detecting a received radio wave strength and reception direction of the beacon signal, and notifying the controller of the detected received radio wave strength and reception direction, in accordance with the radio wave detection instruction, and wherein the controller further includes:

beacon signal transmission means for transmitting a beacon signal including identification information on an own controller;

received radio wave strength detection means for receiving a beacon signal transmitted from each of the plurality of wireless speakers and detecting a received radio wave strength of the beacon signal;

reference coordinate identification means for transmitting, to a first wireless speaker for which a received radio wave strength is detected by the received radio wave strength detection means among the plurality of wireless speakers, a radio wave detection instruction containing designation of identification information on the controller, acquiring a received radio wave strength and reception direction of the controller detected by the first wireless speaker from the first wireless speaker, and identifying a reference coordinate system identified by relative positions of the controller and the first wireless speaker based on the received radio wave strength of the first wireless speaker detected by the received radio wave strength detection means or the received radio wave strength of the controller detected by the first wireless speaker, and the reception direction of the controller detected by the first wireless speaker;

position identification means for performing, for each of the plurality of wireless speakers excluding the first wireless speaker, processing of: transmitting, to the first wireless speaker, a radio wave detection instruction containing designation of identification information on a wireless speaker being a measurement target for which a received radio wave strength is detected by the received radio wave strength detection means; acquiring, from the first wireless speaker, a received radio wave strength and reception direction of the wireless speaker being the measurement target detected by the first wireless speaker; and identifying a position of the wireless speaker being the measurement target based on the received radio wave strength of the wireless speaker being the measurement target detected by the received radio wave strength detection means, the received radio wave strength and reception direction of the wireless speaker being the measurement target detected by the first wireless speaker, and the reference coordinate system identified by the reference coordinate identification means;

installation state determination means for determining installation states of the plurality of wireless speakers with respect to the controller based on the reference coordinate system identified by the reference coordinate identification means and positions of the plurality of wireless speakers excluding the first wireless speaker identified by the position identification means; and output mode determination means for determining an audio signal output mode of audio signals to be output from the plurality of wireless speakers based on the installation states determined by the installation state determination means.

4. A wireless audio system according to claim 2, wherein the controller further includes:

installation state display means for displaying the installation states determined by the installation state determination means; and listener information reception means for receiving designation of a front direction of a listener with the controller under the installation states displayed by the installation state display means, and wherein the output mode determination means of the controller is configured to determine the audio signal output mode of audio signals based on the installation states of the plurality of wireless speakers, in which the front direction of the listener received by the listener information reception means is set, with respect to the controller.

* * * * *